US007891052B2

(12) United States Patent
Haab et al.

(10) Patent No.: US 7,891,052 B2
(45) Date of Patent: Feb. 22, 2011

(54) DEVICE WITH A CARRIAGE FOR HOLDING PANELS AND A SEPARATION ELEMENT

(75) Inventors: Karl Haab, Weggis (CH); Gregor Haab, Baar (CH); Cornel Fuglistaller, Jonen (CH); Reto Beck, Emmenbruecke (CH)

(73) Assignee: Hawa AG, Mettmenstetten (CH)

( * ) Notice: Subject to any disclaimer, the term of this patent is extended or adjusted under 35 U.S.C. 154(b) by 560 days.

(21) Appl. No.: 11/875,181

(22) Filed: Oct. 19, 2007

(65) Prior Publication Data

US 2008/0092330 A1 Apr. 24, 2008

(51) Int. Cl.
*A47H 15/00* (2006.01)
*E05D 15/06* (2006.01)

(52) U.S. Cl. ..... 16/98; 16/105; 16/106; 16/107; 16/91; 16/93 R

(58) Field of Classification Search ..... 16/98, 16/97, 91, 102, 106, 107; 49/409, 410, 420, 49/366; 160/185, 199, 345, 346, 330, 206
See application file for complete search history.

(56) References Cited

U.S. PATENT DOCUMENTS 2,600,670 A * 6/1952 Minium ..... 16/95 R
2,618,808 A * 11/1952 Spence et al. ..... 16/105
2,754,535 A * 7/1956 Plemeng ..... 16/87 R
3,185,111 A * 5/1965 Hess etal. ..... 410/135
3,346,993 A * 10/1967 Johnson ..... 49/409
3,643,529 A * 2/1972 Bright ..... 16/96 R
4,227,355 A * 10/1980 Wendt ..... 52/64
4,633,615 A * 1/1987 Moose ..... 49/425
5,606,826 A * 3/1997 Calhoun ..... 49/138
6,381,904 B1 * 5/2002 Tedescucci ..... 49/409
6,906,026 B1 * 6/2005 Noble et al. ..... 514/2

FOREIGN PATENT DOCUMENTS

EP 0586840 A1 3/1994
WO WO9859140 12/1998
WO WO200632157 A1 3/2006

* cited by examiner

*Primary Examiner*—Chuck Y. Mah
(74) *Attorney, Agent, or Firm*—Shalom Wertsberger; Saltamar Innovations

(57) ABSTRACT

A carriage which serves to hold a panel, has at least one running element such as a magnet, a wheel and/or a sliding element which is held by at least one corresponding magnetic element or supported on a running surface of an at least approximately U-profile or L-profile-shaped rail. The carriage comprises one or two carriage parts which can be anchored to the panel by mounting elements, such that the two carriage parts can be anchored on the opposing sides (4*a*, 4*b*) of the panel. One carriage part is further contemplated, which can be introduced into a groove arranged on the upper side of the panel between the sides and anchored there by the mounting elements. Further provided is a carriage and a mounting device which can be coupled to the carriage and to the glass panel with two assembly parts which are each formed or mounted on one side on the upper side or within a groove of the panel.

6 Claims, 14 Drawing Sheets

FIG. 8a
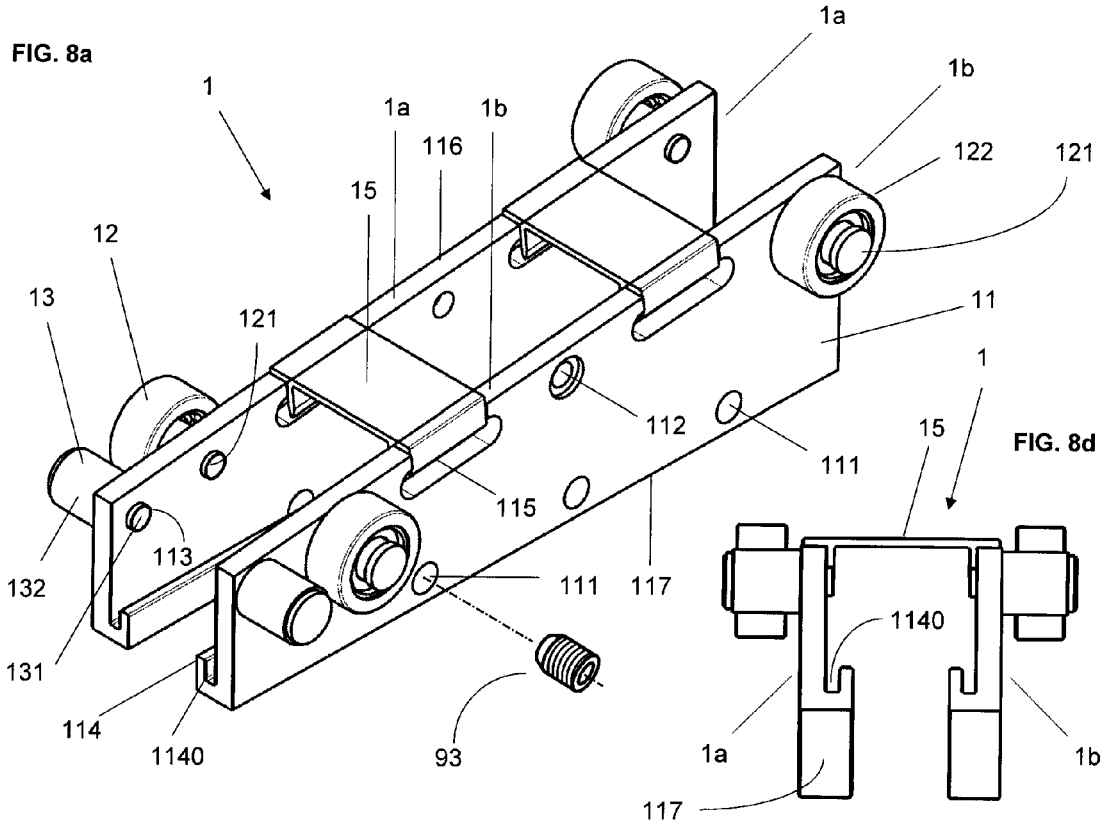
FIG. 8d
FIG. 8b
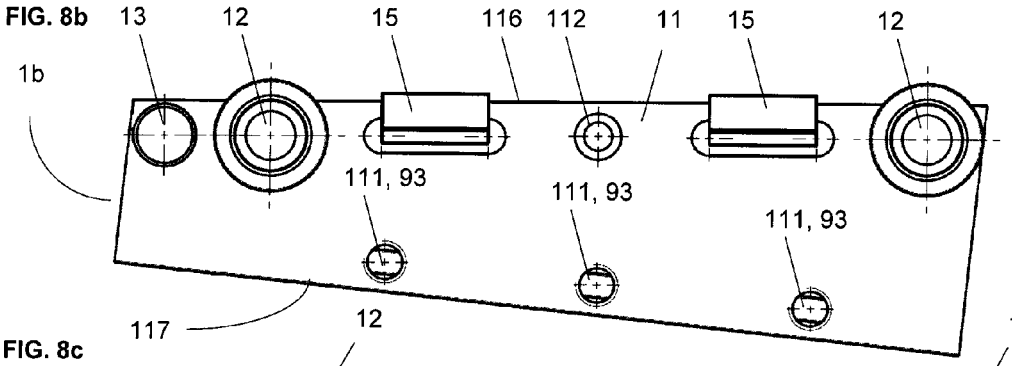
FIG. 8c
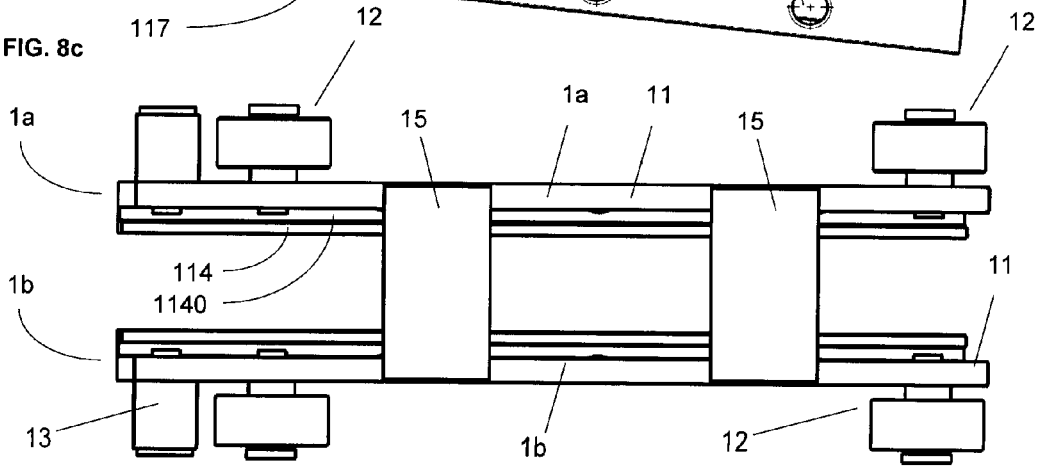

3
35
3501
95
6b
6a
63
13
62
1b
1
12
1a
15
12
2
2a
2b
4
1140
114
2122
2121
152
151
15

152
151
15

FIG. 12
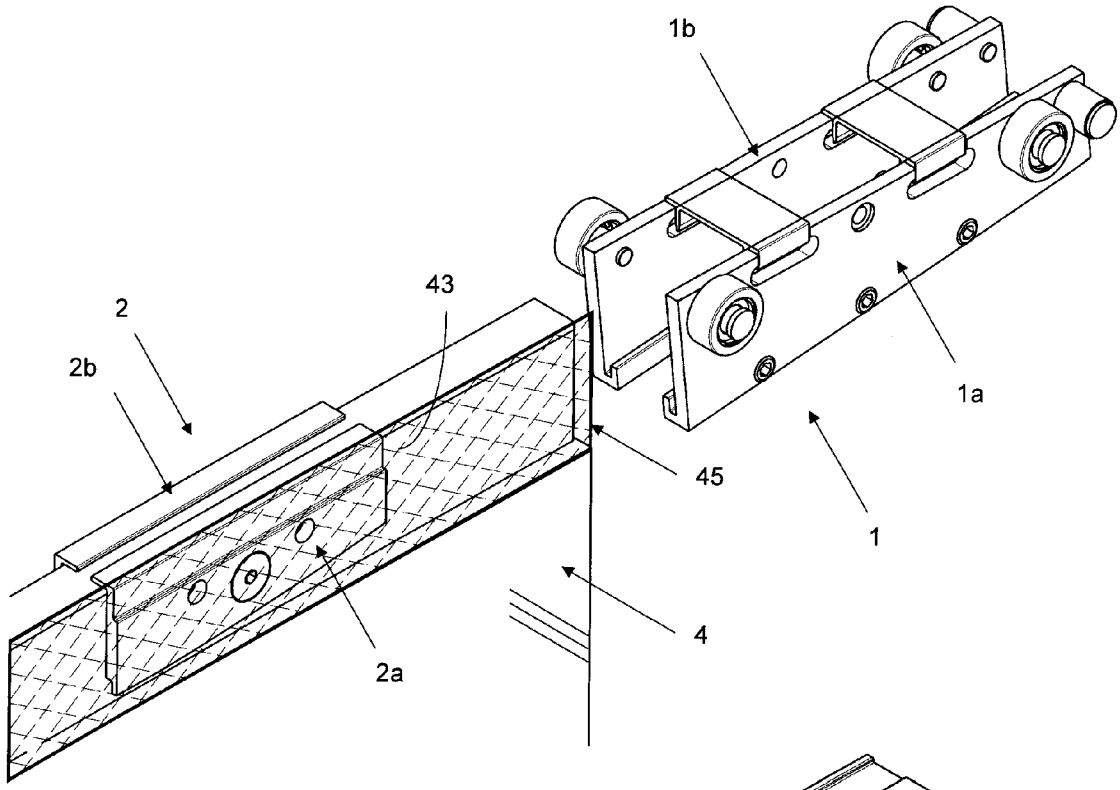
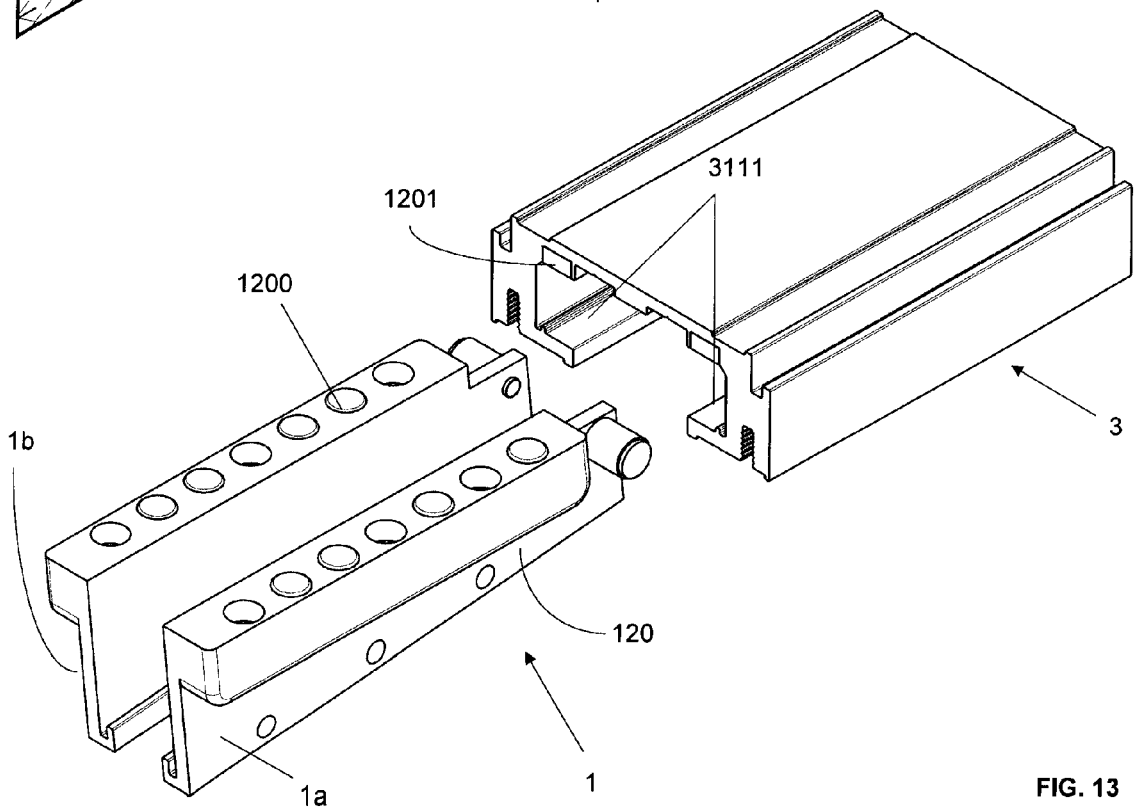
FIG. 13

FIG. 17a
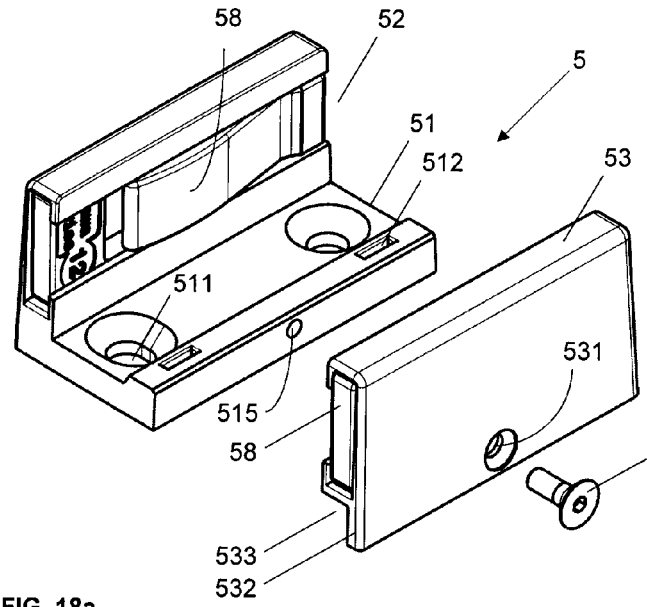
FIG. 17b
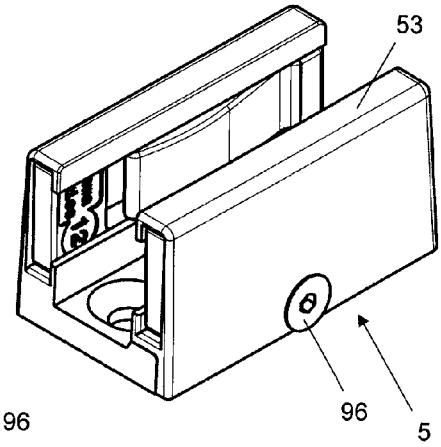
FIG. 18a
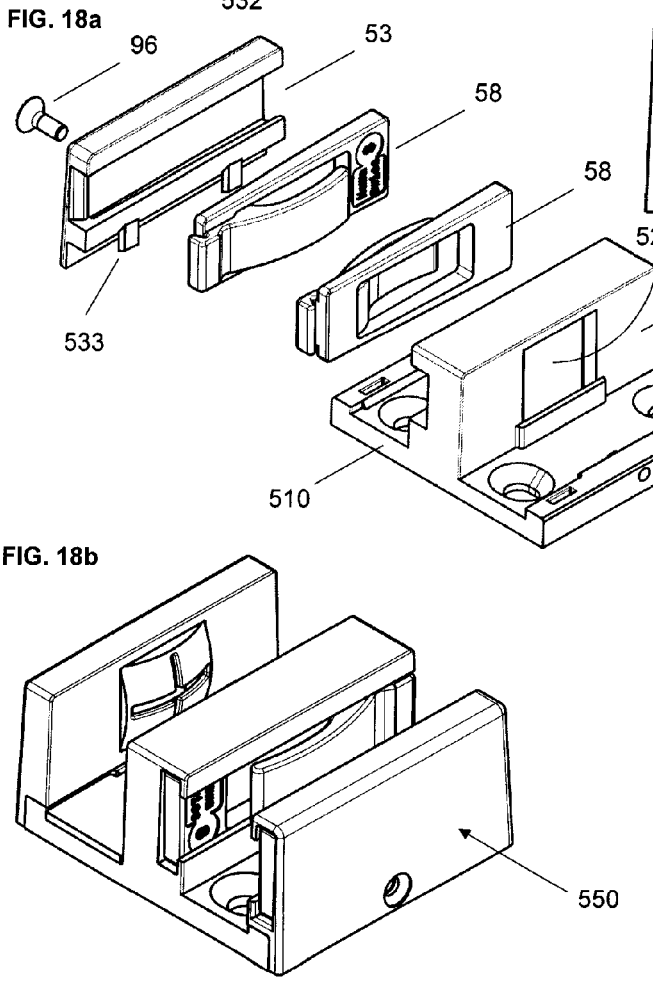
FIG. 18c
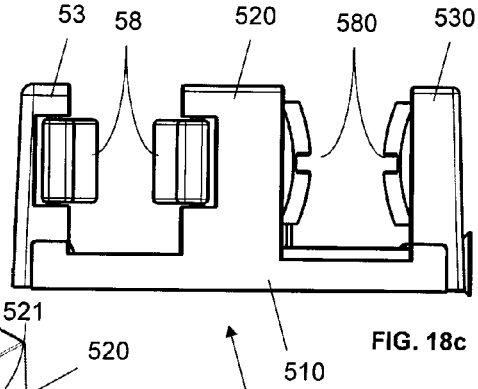
FIG. 18b

DEVICE WITH A CARRIAGE FOR HOLDING PANELS AND A SEPARATION ELEMENT

FIELD OF THE INVENTION

The invention relates to a device with a carriage for holding panels, in particular glass panels, and also to a separation element provided with this device In order to separate or form areas or to close a room or a window opening, glass or wooden walls, sliding elements, doors or shutters are often used, hereinafter referred to as separation elements, which can be fixedly mounted or fixed to carriages which can be displaced along a rail and possibly mounted so as to be rotatable.

A device for holding glass panels is known for example from [1], WO 98/59140 A1, wherein two fixing parts to be introduced into a recess in a glass panel can be coupled to each other by means of a connector which may be guided through a hole provided in the glass panel and thus holds the glass panel in a shape-locking manner. The glass panel can thereby be adjusted by an eccentric adjusting element which is introduced into the hole. Inaccuracies which have arisen during the machining of the glass panel can thereby be compensated. An adjustable connecting screw is held between the two parts of the device, within said recess of the glass panel, said connecting screw being connected to a carriage guided in a running rail.

By means of the device disclosed in [1] the glass panel or frame batten can be mounted, as provided for example in [2], EP 0 586 840 A1. By avoiding a frame batten in the device described in [1], separation elements can be created, of which the panels lie substantially free. The separation elements are covered by mounting elements merely in the region of the mounts. It would still be desirable for different applications, however, if this remaining covering of the separation elements or glass panels could be further reduced or even completely eliminated.

Furthermore, in the device disclosed in [1], besides a hole, a recess is also incorporated into the glass panel for each mount, which requires considerable resources. It would thus be desirable if these resources for machining the glass panels could be reduced.

During the assembly of the devices disclosed in [1] and [2], further adjustments are required, which require further assembly resources. It would, therefore, be additionally desirable if these resources could be reduced.

The carriage described in [1] which is guided in a U-profile-shaped rail comprises a carriage body which is provided with four wheels and in which the above-mentioned connecting screw engages. A relatively large amount of work and materials are also normally required for producing such a carriage. Furthermore, such a rather heavy carriage requires a relatively large amount of space and this results in higher storage and transport costs. It would therefore be further desirable to create a carriage which can be produced more simply and cost-effectively, weighs less and can be more advantageously stored and transported.

SUMMARY

It is thus the object of the present invention to create a device with a carriage serving to hold panels, in particular glass panels, and also a separation element provided with such a carriage which are further developed as desired and are not encumbered with the described shortcomings of the prior art.

In particular, a carriage and a device are created, which allow a panel, particularly a glass panel, to be held so as to be displaceable, while minimizing parts projecting into the area below the carriage. In particular, mount elements connected to the panel, but also the carriage provided with wheels or sliding surfaces, should project as little as possible into the area below the running surfaces of the rail.

The carriage which serves to hold the panel, comprises at least one running element, such as a magnet, a wheel and/or a sliding element. In the event that the carriage comprises a magnet, then the carriage is held by at least one corresponding magnetic element provided in the rail. Else the at least one wheel and/or sliding element is supported on a running surface of a generally U-profile or L-profile-shaped rail. The rail comprises a central part and one or two lateral parts, possibly with a foot element, on the upper side of which the running surface is provided.

According to an embodiment of the invention the carriage comprises preferably two carriage parts which can be fixed by mounting elements on or in the panel. The two carriage parts, which are completely separate or can be coupled to each other, can be anchored on the opposing sides of the panel by mounting elements. Alternatively, the carriage parts can be introduced into a groove incorporated on the upper side of the panel between the panel sides, and can be anchored there by elements. In this embodiment a single-part carriage can be used. The device comprises the carriage and also a mounting device, which can be coupled on one hand to the carriage and on the other hand to the glass panel. In one embodiment the mounting device comprises two combined or separate assembly parts which are mounted to the on the upper side of the panel, on the outer sides or within a groove of the panel. In another embodiment the mounting device consists of mounting elements which are formed on the upper side of the panel, on the outer sides or within a groove of the panel and thus are an integral part of the panel. At least two running elements are preferably provided which are arranged on a one-part carriage body of a carriage, on one of the two carriage parts of a carriage, or in a preferably equal number on the two carriage parts of the carriage. The one-part or two-part carriage can, however, also be provided with only one running element which is guided in a running or guiding rail.

The device comprises the carriage comprising preferably two parts and additional mounting elements.

The mounting elements comprise the anchoring elements provided on the carriage or carriage parts and a mounting device which contains, for each of the anchoring elements, an assembly part disposed within the groove on its sides or on the sides of the panel, a) which are formed or machined on the possibly tapered upper side of the panel, possibly integrally within the groove; or
b) which are formed as one part or multiple parts and are mounted by means of assembly means such as screws on the possibly tapered upper side of the panel, possibly within the groove; or
c) which are formed as one part or multiple parts and connected to each other by means of a bolt which is guided through a continuous recess in the panel.

The device according to the preferred embodiment of the invention and the carriage thus allow the panel to be held in a displaceable manner, without device parts projecting into the area below the carriage so as to cause interference. As the carriage is anchored within the groove on the upper side of the panel, said carriage can be held entirely free from interference-causing elements.

The connection of the carriage parts, or their carriage part bodies on the upper side of the panel, preferably within the groove, can be realised in different ways. For example, the carriage part bodies can be connected to each other by a bolt which is guided through an opening in the panel. Embodiments are particularly preferable, however, with a mounting device mounted on, or in, the groove of the panel which allows the carriage or a carriage part body to be hung or displaced therein.

The two carriage part bodies mounted on the outer side of the panel are preferably in plate form and provided on their lower side with a strip-like anchoring element orientated against the panel.

If the carriage is introduced with only one carriage part into the groove within the panel, it is preferably provided with two anchoring elements facing away from each other, and orientated against the lateral walls of the groove.

Each of the anchoring elements comprises a receiving groove extending parallel to the panel, which can easily be coupled with a flange element of the mounting device. The flange element may be stepped or provided with a shoulder.

The mounting device preferably comprises two assembly parts which are each machined, formed or mounted on one side on the upper side of the panel, or within the groove and possibly connected to each other by means of a bolt.

The assembly parts are for example I-profile or L-profile-shaped plates, which are formed symmetrically to a plane. The use of two assembly parts separated from each other, allows the assembly of the mounting device on panels of different thickness or diameter. If a uniform thickness of the panel is provided, the two assembly parts are preferably coupled by an additional middle element to form a U-shaped profile which can be easily placed and mounted on the panel.

The carriage according to the invention preferably consists of two carriage parts which can be produced completely separately from each other.

In a preferred embodiment, therefore, the two carriage parts do not form a carriage until they are fixed to the panel. The panel, for example a glass panel, and/or the mounting device provided thereon thus form in this embodiment, a part of the carriage structure which connects the two carriage parts to each other. The mounting device comprises the assembly means required for connection to the carriage, such as shoulders, flanges or edges. These assembly means can also be advantageously provided, for example machined, in the upper side or the upper end piece of the panel.

This two-part formation of the carriage has numerous further advantages. The carriage parts, which each comprise a carriage body provided with one or more running elements, can be produced efficiently. The carriage part bodies can for example be extruded or produced from a metal plate which may easily be machined or bent. The necessary openings for receiving shafts and screws can be incorporated into the carriage part bodies with ease. The two carriage parts and/or the carriage part bodies are preferably formed symmetrically to a plane which lies perpendicular to the running direction of the carriage. In order to carry out constructive changes, therefore, only one of the carriage part bodies can be machined and subsequently mirrored on the plane mentioned. Instead of wheels and rollers the carriage can also have sliding elements and/or magnetic bearings as running elements, which correspond to corresponding elements such as sliding elements or magnetic elements. Carriages with sliding surfaces can thereby be realised with minimal structural heights.

The carriage part bodies take up limited space and can for example be advantageously stored and transported lying one against the other.

The two carriage part bodies can, however, also be pre-connected to each other, before being connected to the panel, either fixedly or loosely, by rigid or elastic elements. The two carriage part bodies can be mounted particularly easily if they are connected to each other, before assembly, by a preferably elastic coupling element. The coupling element can be subsequently removed or left in place. The elastic coupling element further allows the reciprocal displacement and/or rotation of the carriage part bodies, which may be necessary to ensure an even load on all running elements. All running elements, for example 4 or 6 wheels, are thereby evenly loaded. In a further preferred embodiment the elastic coupling element may be folded, or folded together, for example in the manner of a bellows. Said foldable elastic coupling element can thereby be compressed, so that the running elements of the carriage parts, such as wheels, rollers or sliding elements, can be introduced between the foot elements of the U-profile-shaped and placed onto the running surface of the rail. This embodiment of the carriage or the elastic coupling element is particularly advantageous as it allows the assembly and/or disassembly of a carriage, in an already installed rail, even if the lateral entry openings are closed, for example by brickwork. The carriage can therefore be introduced with a hand grip from below, into the mounted rail and removed again, which is also extraordinarily advantageous for subsequent maintenance work.

At least one protective elastic element is preferably provided between the assembly parts and the panel. The protective elastic element prevents the assembly parts from lying directly on the panel and exerting pressure on points thereof.

The bolt serving to connect the two carriage parts to be mounted on the outer sides of the panel, preferably consists of elastic material or of metal coated with elastic material. In order to compensate for inaccuracies in the machining of the glass panel, an eccentric element may be placed on the bolt.

In a preferred embodiment the bolt is preferably held in the middle of a recess in the panel, or in the middle of a recess in a bearing element inserted into the panel. The bearing element extends parallel to the rail and thus allows a displacement of the bolt, or the glass panel relative to the bolt, in both directions. In order to counteract this relative movement, in this embodiment of the invention, elastic damping elements are provided on both sides of the bolt, which prevents the direct impact of the forces of the moving panel on the mounting device or the carriage, which has possibly reached a rail buffer that forming the stop. The forces are therefore absorbed directly where they occur. The load on the sliding mount, or other elements of the device, is thus reduced, and parts can therefore be dimensioned more simply, to carry operational loads over a longer period.

The through opening of the recess in the panel for guiding through the bolt is preferably disposed as close as possible to the upper side or the upper edge of the panel, without effecting the necessary strength. The opening can thus be disposed closer to the upper side if the opening is opened in a V shape against the upper side of the panel. In comparison with the solutions known from the prior art, however, fewer resources are required in each case, with or without V-shaped opening, for machining the panel, as only one opening is to be provided for each mount.

The height adjustment and levelling of the mounted panel can be carried out easily utilizing the device. For this, the anchoring elements of the carriage orientated so as to be inclined relative to the upper side of the panel, and substantially parallel to the lower sides of the assembly elements which also extends in an inclined manner. Thus each comprises a flange element, which can be introduced into the receiving groove and/or shoulder supported on the anchoring element. The mounting device and the carriage parts can therefore be displaced inside each other, and subsequently laterally against each other, for height adjustment. The height of the upper edge of the panel can be set as desired through the extent of this reciprocal displacement. In order that the assembly part can be displaced relative to the associated carriage part body without overlapping it, the length of the upper side of the carriage part is preferably selected so as to be greater by around factor 1.2-1.4, than the length of the upper side of the associated assembly part. The inclination of the anchoring elements is preferably selected so that between the corner values of the maximum possible reciprocal displacement. Thus a height adjustment range of from 0.5 to 1.5 cm is preferably offered between the panel and the carriage guided in the rail.

As the panel is normally held by two mounting devices, it can be adjusted in terms of height and levelled by individual displacement of the carriages. In order that the mounting device and the carriage constantly lie essentially flat against each other at the contact points, (independently of the selected adjustment) the lower side of the assembly part is of convex form. For example, a rounded area with a radius in the range of 0.5 m to 2.5 m is provided. The assembly part thus rolls on the anchoring element if the separation element is adjusted in height on the other side. Alternatively, the anchoring element can be formed so as to be concave, so that the then preferably straight lower side of the assembly part can roll thereon.

Each of the two carriage part bodies can comprise at least one threaded bore for receiving an assembly screw or a threaded pin. With the aid of which the carriage part body can be fixedly connected to the panel or to the mounting device connected to the panel. The assembly screw or the threaded pin may be turned towards the panel.

The carriage part body can comprise at least one but preferably two or three bores which serve to receive a bearing shaft for a wheel or a wing element. The wing element is provided with at least one sliding element or at least one magnetically working element.

The carriage can thus be adapted to varied loads by providing an appropriate number of running elements, for example 2, 4, 6 or more.

The carriage part body can comprise at least one bore which serves to receive an assembly shaft for a preferably elastic locking element which can cooperate with elements of a buffer device.

The carriage part body can comprise at least one recess for the engagement of a preferably elastic coupling element, for fixedly or loosely coupling the two carriage part bodies.

The rail serving to receive the carriage can be directly connected to the ceiling or held within an assembly profile sunk into the ceiling.

On the lower side of at least one of the lateral parts of the rail, an auxiliary profile can advantageously be provided. The auxiliary profile serves to receive the upper side of a stationary additional panel and/or comprise a wing element which is orientated against the panel and visually covers the assembled device.

Thus in various embodiments the device, together with a panel supported by it, (preferably a glass panel) form a separation element which has advantageous running behaviour and excellent aesthetic properties.

The device can further be sunk, into a ceiling, together with the rail, utilizing an assembly profile, so that an area can be mechanically and optically closed off.

BRIEF DESCRIPTION OF THE DRAWINGS

Aspects of the invention are described in greater detail below with the aid of drawings, in which:

FIGS. 8 *a-d* show a carriage 1 provided with four wheels 12. The carriage 1 consists of two substantially symmetrical carriage parts which are connected to each other by two elastic elements 15 so as to be releasable.

FIG. 12 shows the mounting device 2 of FIG. 1, of which the assembly parts 2*a*, 2*b* are mounted on a tapered upper part 43 of the panel 4. The tapered upper part can be covered with a covering element 45, after assembly of the carriage 1 which forms a flat surface flush with the panel 4

FIG. 13 shows a carriage which can be connected, as in the previously shown carriages 1, to a mounting device 2, but of which the running elements are sliding elements 120 and magnetic bearings which are formed by magnets 1200 in the carriage body 1*a*, 1*b* and magnetic elements 1201 in the rail 3 corresponding thereto.

FIG. 17 *a-b* show a single bottom guide 5 with a lateral element 53 which can be disassembled.

FIG. 18 *a-c* show a combined bottom guide 550 with lateral elements 53, 530 which can be disassembled.

DETAILED DESCRIPTION

Figure 1:
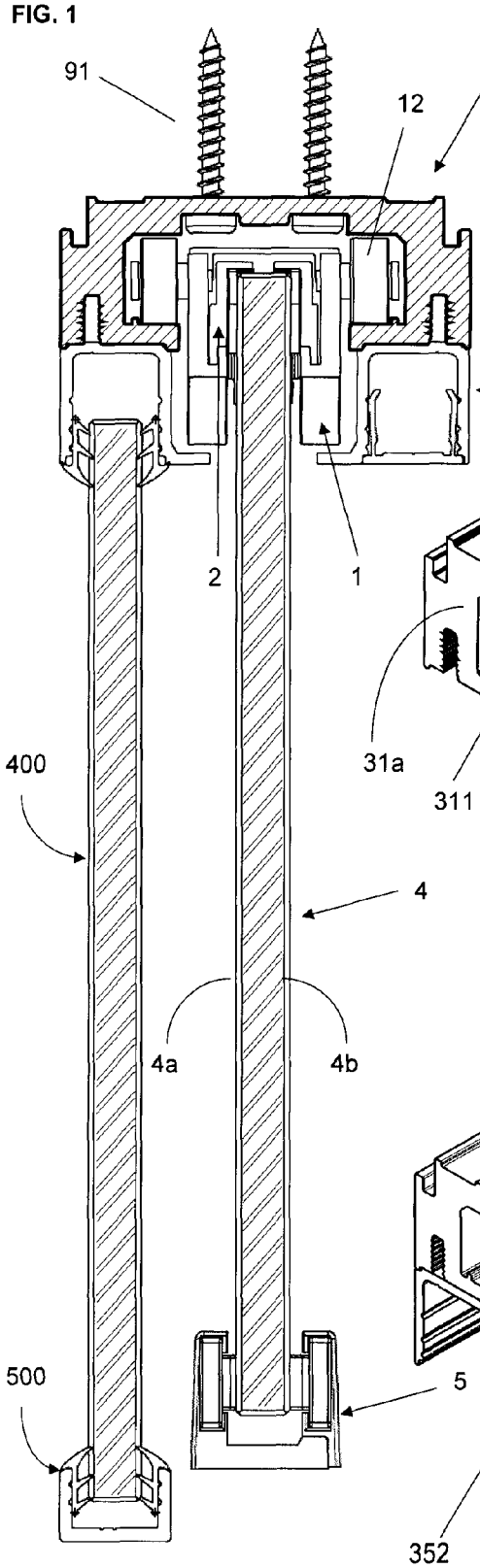
FIG. 1 shows a device 1 with a carriage 1 guided in a rail 3. The carriage 1 is anchored on both sides in a mounting device 2 which is connected to a glass panel 4. The glass panel is supported so as to be displaceable in a bottom guide 5.

FIG. 1 shows a device 1 with a carriage 1 which is guided in the conventional way by running elements in the form of wheels 12 in a rail 3. Rail 3 comprises two lateral parts 31*a*, 31*b* connected to each other by a central part 32. Lateral parts 31*a*, 31*b* comprise foot elements 311 orientated against each other. Running surfaces 3111 are provided on the upper sides of foot elements 311, for the running elements 12 of the carriage 1 (see FIG. 3).

The carriage 1 is anchored on both sides of a mounting device 2 which is mounted on the upper side of a panel 4, preferably a glass panel, which has a front side 4*a* and a rear side 4*b*. The mounting device 2 which has a small structural height is completely covered by the carriage 1 which also has only a small structural height and is not visible from the side after it has been mounted. The panel 4 with the mounting device 2 which can be placed on the panel 4 or formed or machined thereon, is raised almost to the upper side of the carriage 1, thus leaving no, or only minimal, gaps visible from the outside, and an almost sealed or easily sealable closure results.

Figures 9A, 9B, 9C, 9D:
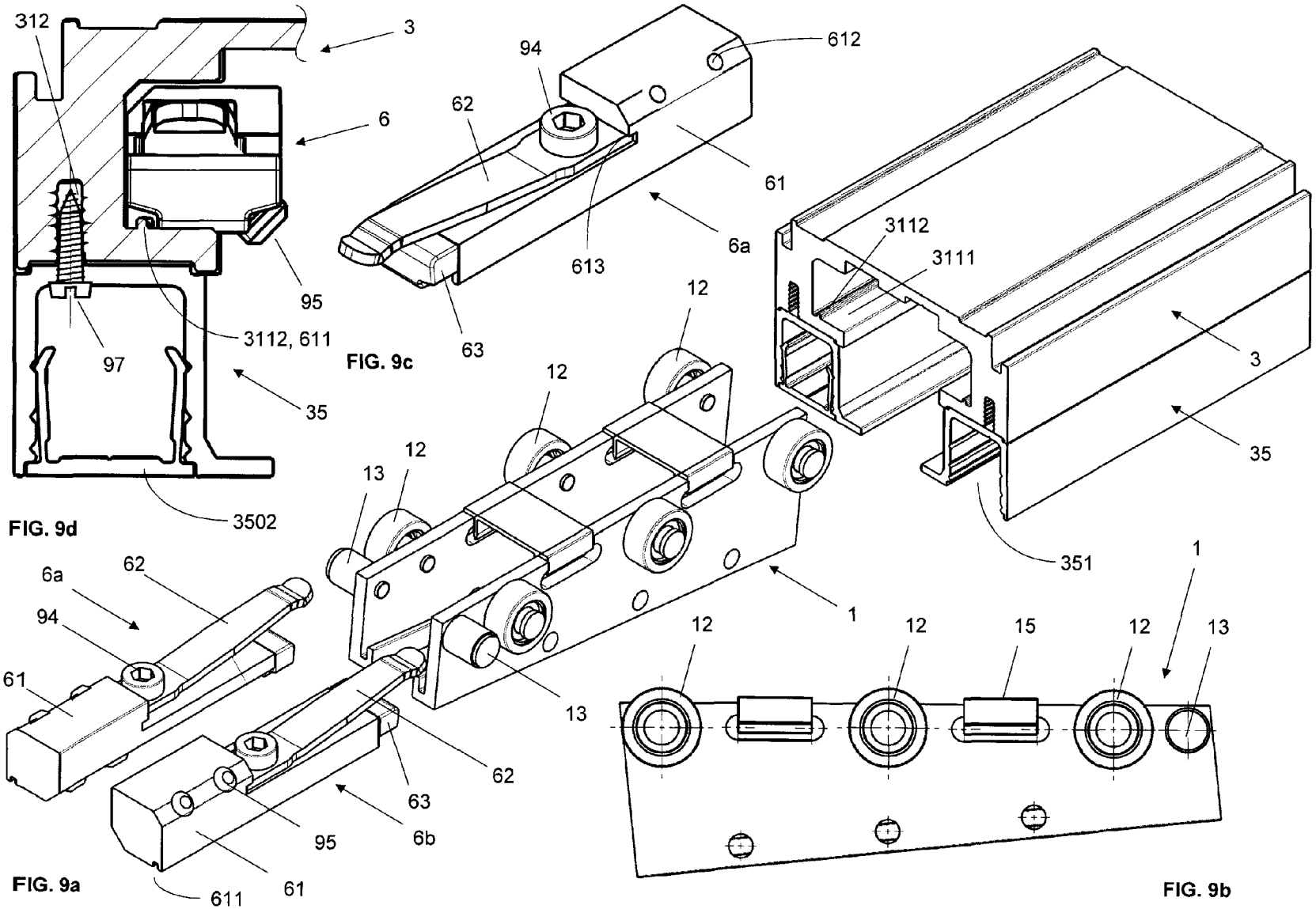
FIGS. 9 *a-d* show a carriage 1 provided with six wheels 12. The carriage 1 is introduced into a rail 3 together with two buffer devices 6 which are symmetrical to each other.
Figure 15:
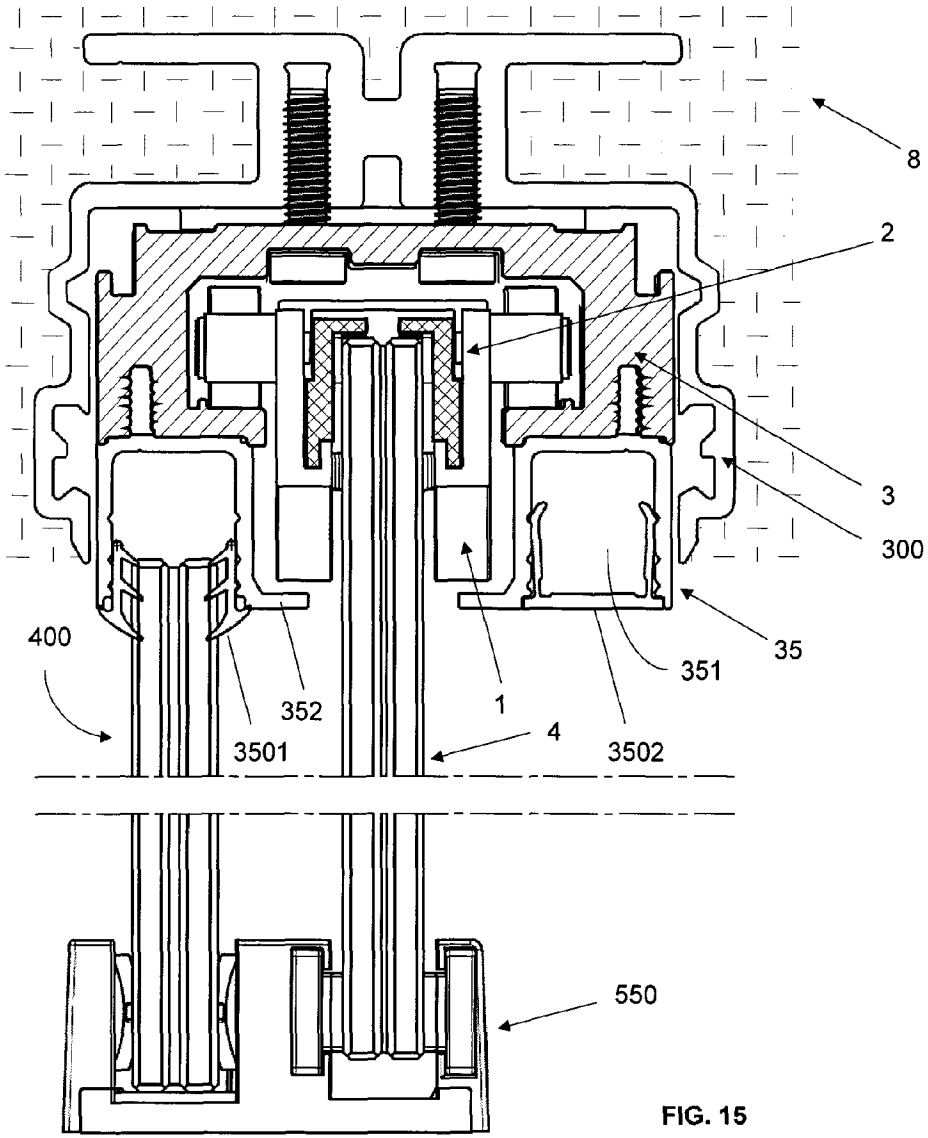
FIG. 15 shows the device of FIG. 1 with a rail 3 which is supported in an assembly profile 300 sunk into the ceiling 8, and with a combined bottom guide 550 for guiding the displaceable glass panel 4 and holding a stationary glass panel 400.

U-profile-shaped auxiliary profiles 35 are fixed to the lateral parts 31*a*, 31*b* of the rail 3 by screws 97 which are screwed into a screw channel 312 in the associated lateral part 31 (see FIG. 9*d* and FIG. 15).

Both auxiliary profiles 35 comprise a channel 351 for receiving a stationary panel 400 and a covering wing 352 which is orientated against the displaceable panel 4 and serves as an optical closure element.

In the left auxiliary profile 35 of FIG. 1 and FIG. 15, a stationary panel 400, preferably a glass panel, supported at the bottom with a bottom guide 500 is held by a seal 3501. A covering element 3502 is inserted into the right auxiliary profile 35 of FIG. 1 and FIG. 15. The covering element closes the auxiliary profile 35.

Figure 2:
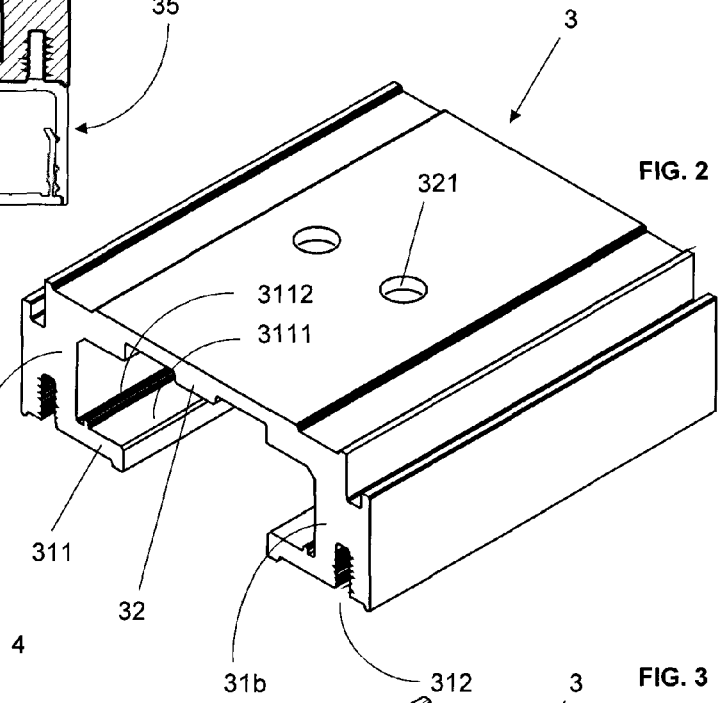
FIG. 2 shows the rail 3 of FIG. 1 which comprises two lateral parts 31*a*, 31*b* connected to each other by a central part 32. The lateral parts 31*a*, 31*b* comprise foot elements 311 orientated against each other, on the upper sides of which running surfaces 3111 for running elements 12 of the carriage 1 are provided.

FIG. 2 shows the above-described rail 3 of FIG. 1. Two holes 321 are provided in the central part 32. The holes serve to guide the assembly screws 91 through the central part. Besides the running surfaces 3111, the rail 3 comprises a resilient strip 3112 which serves to support a buffer device 6, as shown in FIG. 6.

Figure 3:
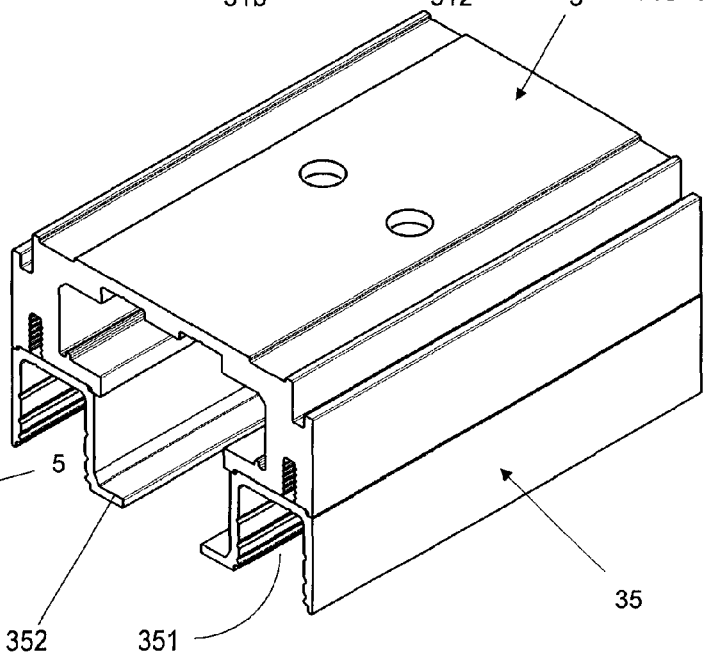
FIG. 3 shows the rail 3 of FIG. 2, on the lateral parts 31*a*, 31*b* of which an auxiliary profile 35 is provided. The auxiliary profile serves as an optical closure element or to hold a stationary panel 400, preferably a glass panel.

FIG. 3 shows the rail 3 of FIG. 2, with an auxiliary profile 35 provided on each side of the lateral plates 31*a* and 31*b*.

Figure 4A:
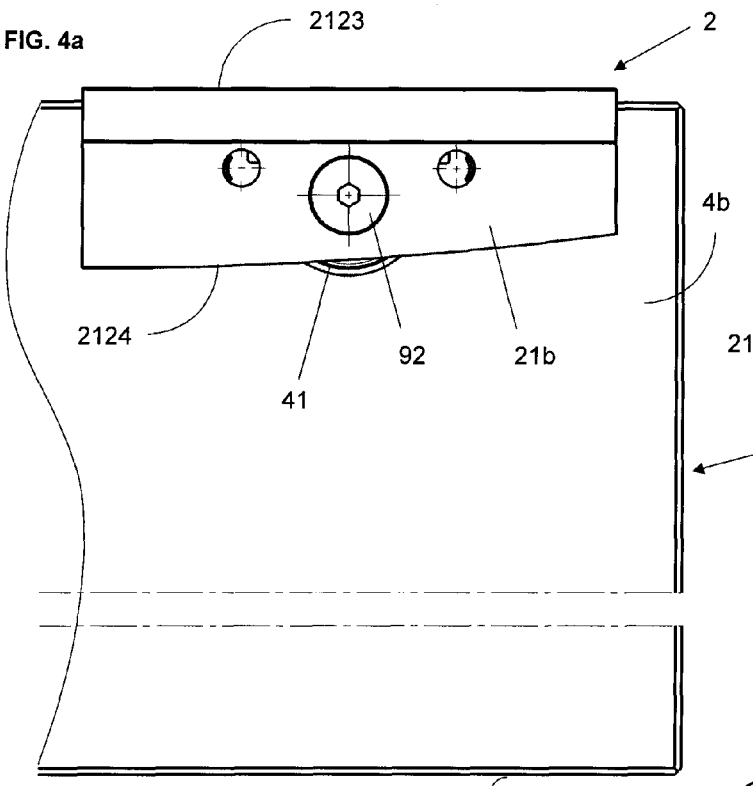
FIGS. 4*a-c* show different views of the glass panel 4 of FIG. 1 with a mounting device 2.
Figure 4B:
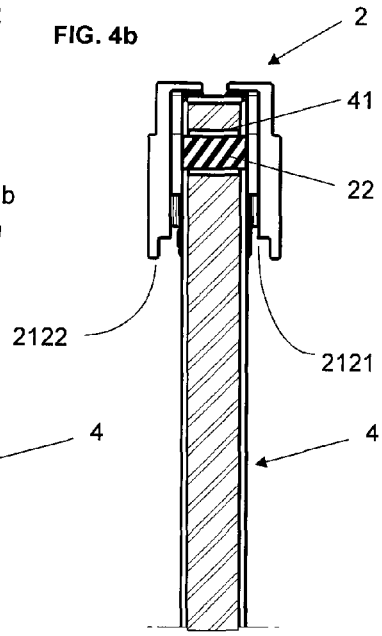
Figure 4C:
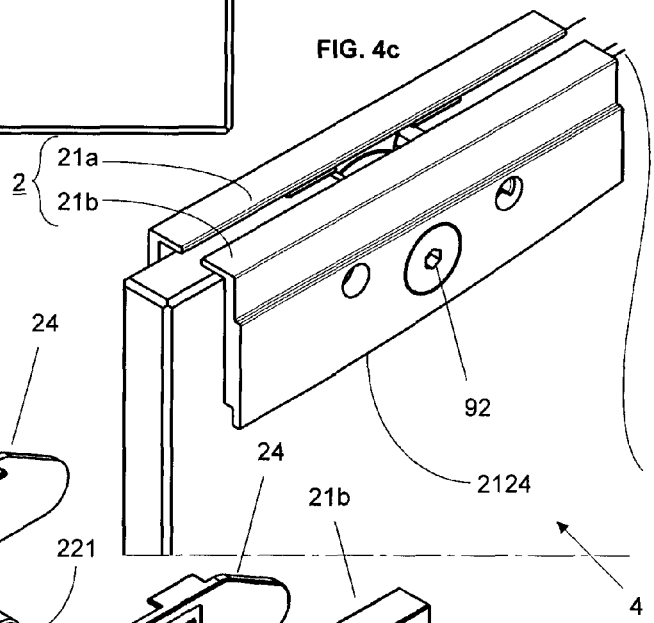
Figure 5:
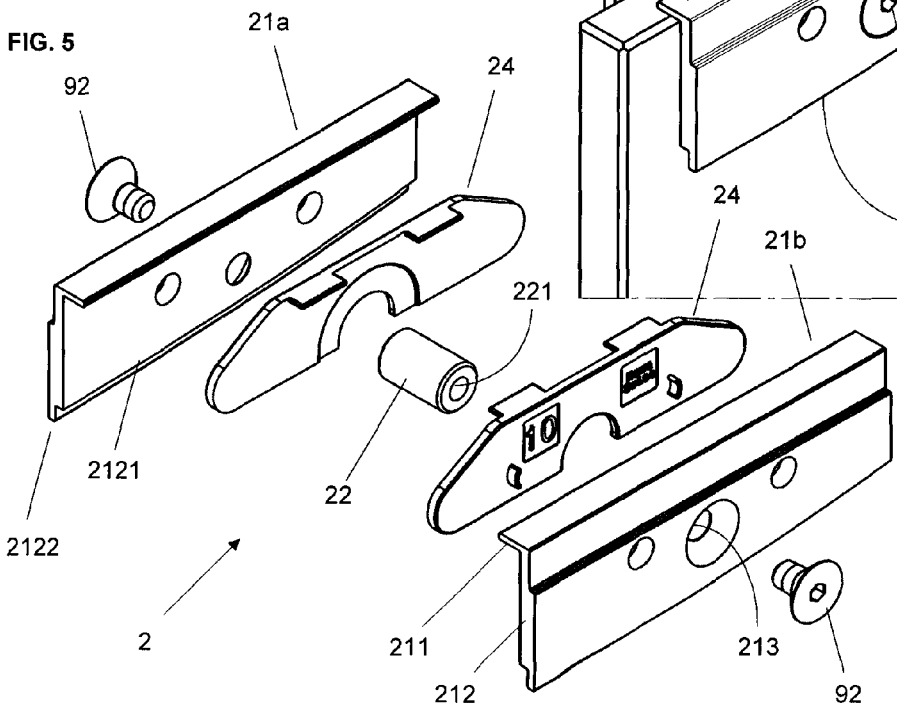
FIG. 5 shows the mounting device of FIG. 1 consisting of two assembly parts 21*a*, 21*b* symmetrical to each other, two identical protective elements 24, and a bolt 22 provided with a threaded bore 221.
Figure 7:
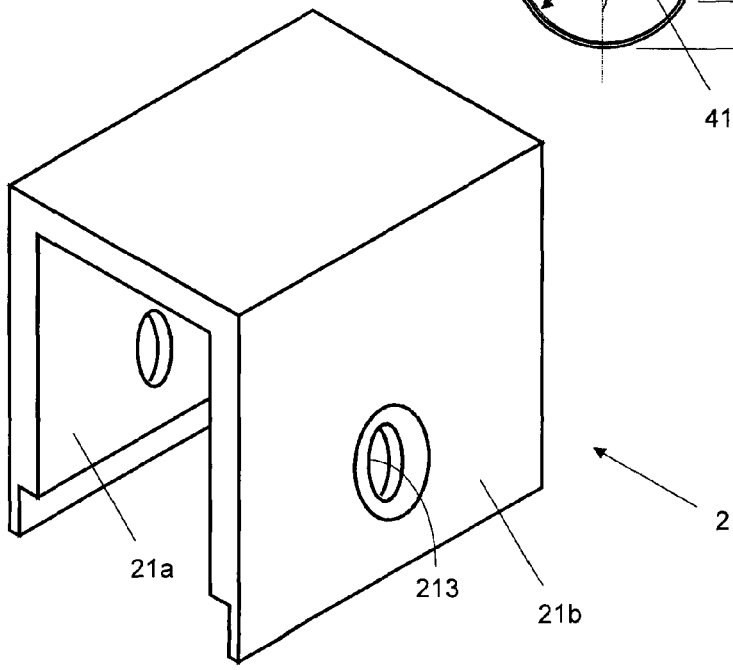
FIG. 7 shows a mounting device 2, of which the assembly parts 21*a*, 21*b*, together with a middle element, form a U-shaped profile.

FIG. 4*a*, FIG. 4*b* und FIG. 4*c* show the glass panel 4 of FIG. 1. Mounting device 2 is shown mounted to the panel in FIG. 5 Mounting device 2 comprises two assembly parts 21*a*, 21*b*, two preferably identical protective elastic elements 24 and a bolt 22 provided with a threaded bore 221, on which the assembly parts 21*a*, 21*b* can be mounted by screws 92. The two assembly parts 21*a*, 21*b*, preferably symmetrically disposed relative to panel 4, comprise an L-profile with a shorter head part 211 and a longer lateral part 212. In certain embodiments, the two assembly parts 21*a* and 21*b* may be integrated to form a U-shaped profile, as shown in FIG. 7. As the mounting devices 2 are mostly to be used for panels of different thickness, two separate assembly parts 21*a*, 21*b* are preferably used.

FIG. 4*a* shows the rear side 4*b* of the panel 4 with the assembly part 21*b* which is connected by an assembly screw 92 to the bolt 22 which is disposed in an opening 41 provided in the panel 4. It is further shown in FIG. 4*a* that the mounting device 2 comprises an upper side 2123 extending parallel to the upper edge of the panel 4 and a lower side 2124 extending in a slightly inclined manner relative thereto and formed convexly.

FIG. 4*b* shows a section through the opening 41 of the panel 4 surrounded completely by glass and through the two-part mounting device 2. It can be seen that the lateral parts 212 each comprise on the lower side a flange element 2122 which outwardly defines a shoulder 2121 facing the panel 4. The flange element 2122 and the shoulder 2121 extend parallel to each other and are preferably convexly formed.

Figure 6A:
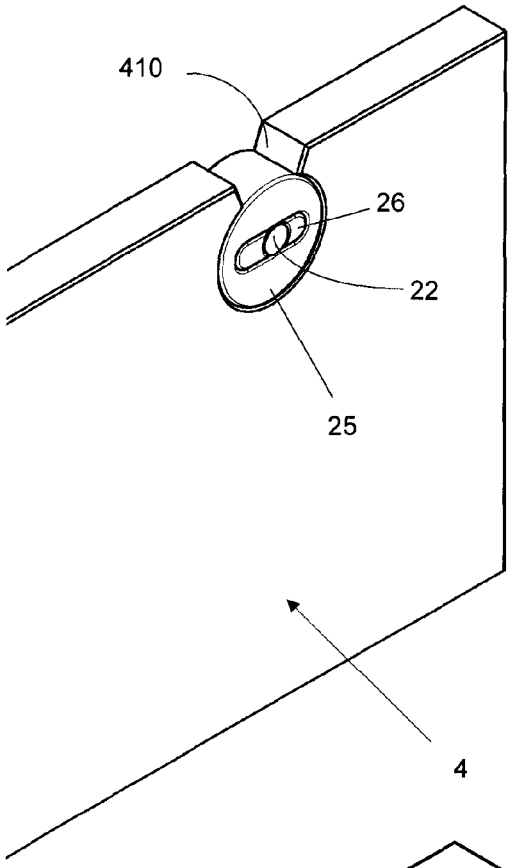
FIGS. 6 *a-c* show a panel 4 with a round recess 41 which is open at the top through a V-shaped part segment 410. A bearing element 25 with an elongated passage opening 251 can be inserted into the recess. The elongated passage serves to support the bolt 22, dampened by damping elements 26.
Figure 6B:
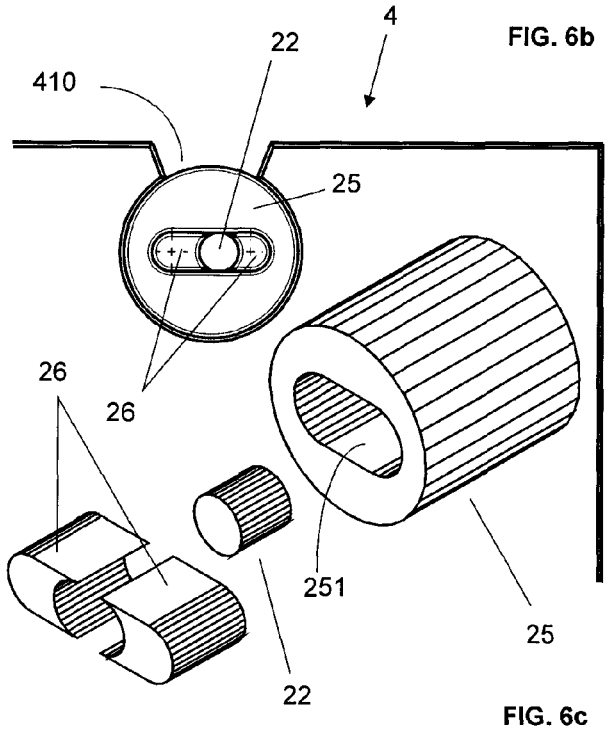
Figure 6C:
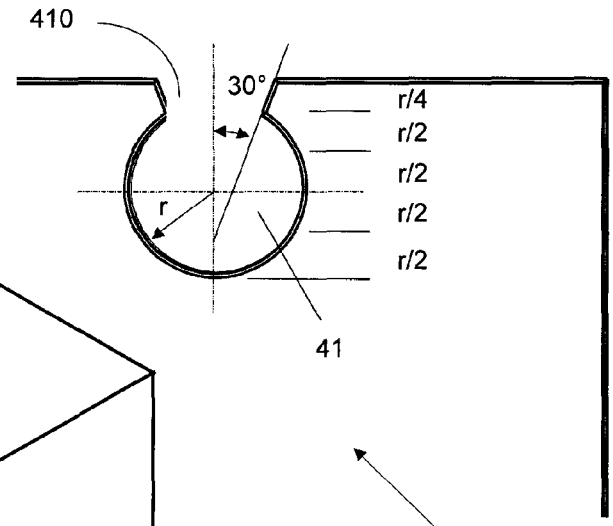

FIG. 6*a*, FIG. 6*b* and FIG. 6*c* show a panel 4 with a round recess 41 which is open at the top through a V-shaped part segment 410. In FIGS. 6*a* and 6*b* a bearing element 25 with an elongated passage opening 251 is inserted into the recess 41. Two resilient elements or damping elements 26 are provided in passage opening 251. The resilient elements or damping elements 26 elastically support the bolt 22 inserted into the passage opening 251. The elastic support of the bolt 22, protects against hard mechanical stops which could cause noise, and possibly impose excessive load on the device.

FIG. 6*c* shows the recess 41 in the panel 4 which is outwardly open in a V shape. The V-shaped opening 410 allows the round recess to be placed closer to the upper edge of the panel 4 without risk of breakage of the glass with greater loading of the bolt 22 or the bearing element 25.

FIGS. 8*a* to 8*d* show different representations of a carriage 1 which consists of two preferably symmetrically carriage parts 1*a*, 1*b* comprising a wedge-shaped plate, preferably made of metal or plastic that forms a carriage part body 11. Each carriage part body 11 comprises on the upper side 116 two recesses 115 for receiving a preferably elastic coupling element 15, three bores 112 for receiving shafts 121 for wheels 12 with rollers 122, and also a bore 113 which serves to receive an assembly shaft 131 for a locking element 13 or for a locking cylinder 132. On the lower side 117, the carriage part body 11 comprises three bores 111 serving to receive threaded bolts 93 and also a straight, rail-form anchoring element 114 which forms a receiving groove 1140. Said anchoring element 114 preferably forms a small U-shaped profile facing the panel 4.

The carriage part body 11 can thus be easily produced by extrusion or bending and subsequent simple machining by boring or stamping. The coupling elements 15 provided on the upper side 116 of the carriage part bodies 11 can be provided as auxiliaries in order to facilitate the assembly of the carriage 1, by holding the two carriage parts 1*a*, 1*b* in a predetermined relationship. For adaptation to the panel 4 load, the carriage parts 1*a*, 1*b* can each be provided with one, two or three wheels 12. The optionally provided locking elements 13 disposed on the front side of the carriage 1 and cooperate in the stop region with buffer springs 62 and buffer elements 63 of buffer devices 6, as shown in FIG. 9.

FIGS. 9*a* and 9*b* show a carriage 1 according to the invention provided with six wheels 12 which is introduced, together with two buffer devices 6*a*, 6*b*, into a rail 3 in such a way that the wheels 12 roll on the associated running surfaces

3111 of the rail 3. The buffer devices 6*a*, 6*b* which are preferably symmetrical to each other in relation to a plane defined by the panel 4 are each placed on one of the running surfaces 3111 and held there by a resilient strip 3112 arranged parallel to the associated running surface 3111. The resilient strip 3112 penetrates into a groove 611 in the body 61 of the buffer device 6*a* or 6*b* (see FIG. 9*d*). The buffer device 6*a*, 6*b* can be locked in the rail 3 by assembly screws, such as threaded bolts 95, provided with a cup point. Threaded bolts 95 are guided through bores 612 in the buffer body 61.

FIG. 9*c* shows the buffer device 6*a* of FIG. 9*a*. The buffer body 61 has an elastic buffer element 63 on the front side, into which an assembly screw 94 is screwed. A buffer spring 62 is inserted into an assembly groove 613 in the buffer body 61, and is held in position by the assembly screw 94, possibly impacted with prestressing.

Figures 10A, 10B, 10C:
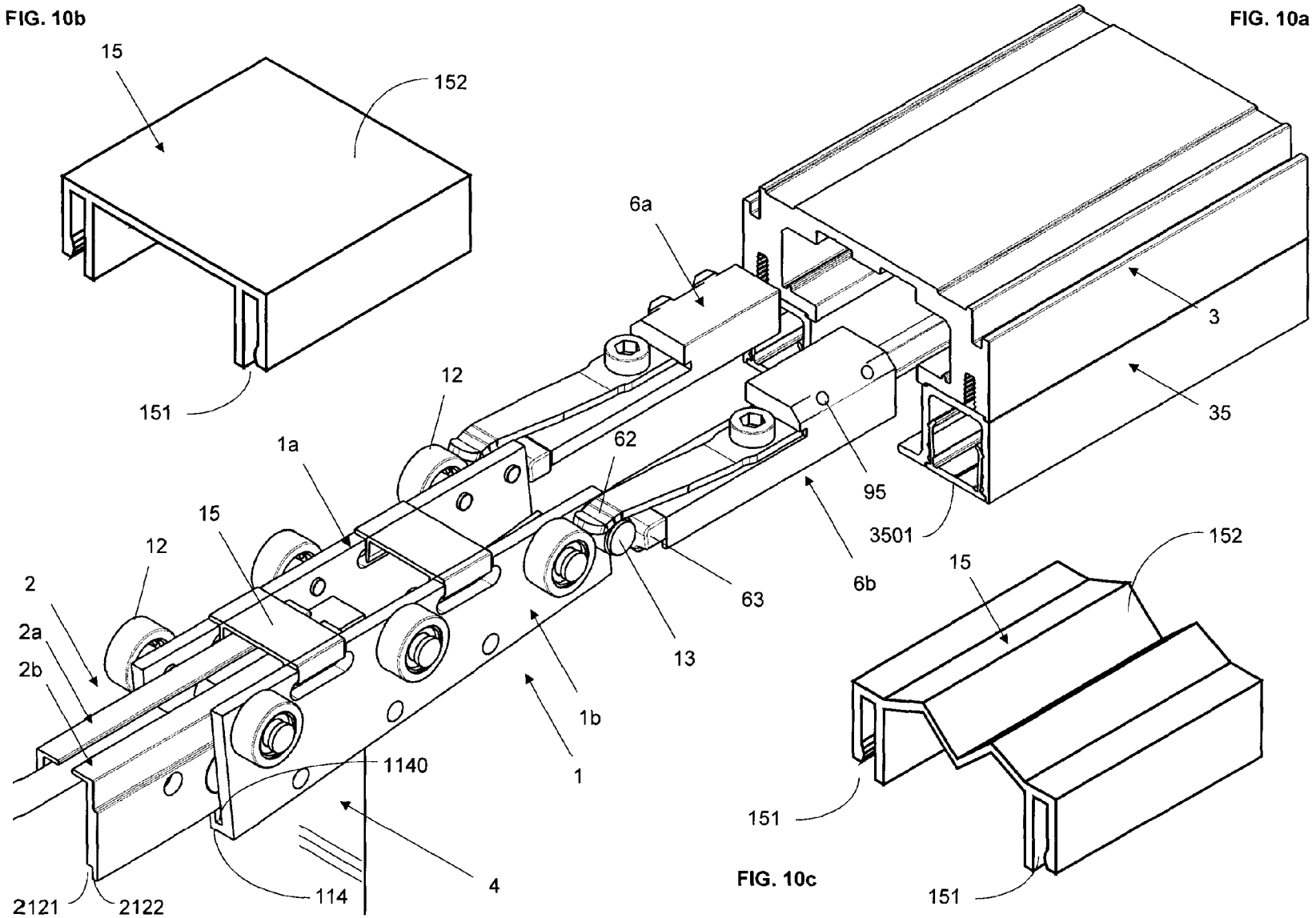
FIGS. 10 *a-c* shows the carriage 1 of FIG. 9*a* in engagement with a mounting device 2 and two buffer devices 6, with detailed representations of the elastic element 15 in preferred embodiments.

FIG. 10*a* shows the carriage of FIG. 9*a* in engagement with a mounting device 2 and two buffer devices 6. The convex flange 2122 of the associated assembly part 2*b* is introduced into the receiving groove 1140 of the anchoring element 114 and the convex shoulder 2121 is supported on the anchoring element 114 of the carriage part 1*b*. Thus, the mounting device 2 and the carriage 1 can be displaced sufficiently against each other, until the panel 4 is held at a desired height and can be fixed by tightening the assembly screws 93. Assembly screws 93 are turned against the flange 2122. There are alternative adjustment possibilities, for example by catch which allows step-by-step adjustment and which otherwise holds the device parts in position. Furthermore, the cooperation of the locking element 13 with the buffer element 63 and the buffer spring 62 of the buffer device 6*b* is shown. This arrangement allows the separation element to be stopped and held. FIG. 10 shows one side of the separation element with the device. The device is mounted in the same way on the other side of the separation element.

FIG. 10*b* shows an elastic coupling element 15 which comprises two bracket elements 151 connected to each other by a connecting element 152. Bracket elements 151 can engage in the openings 115 in the carriage parts 1*a*, 1*b*. FIG. 10*c* shows an elastic coupling element 15 which comprises a bellows-like and thus foldable connecting element 152. Two carriage parts 1*a* and 1*b* held with this elastic coupling element 15 can thus be pushed against each other sufficiently to be introduced, together with the wheels 12, between the foot elements 311 of the U-profile-shaped rail 3. This embodiment of the carriage or the elastic coupling element thus allows the assembly and the disassembly of the carriage in or from, an already installed rail 3.

Figure 11B:
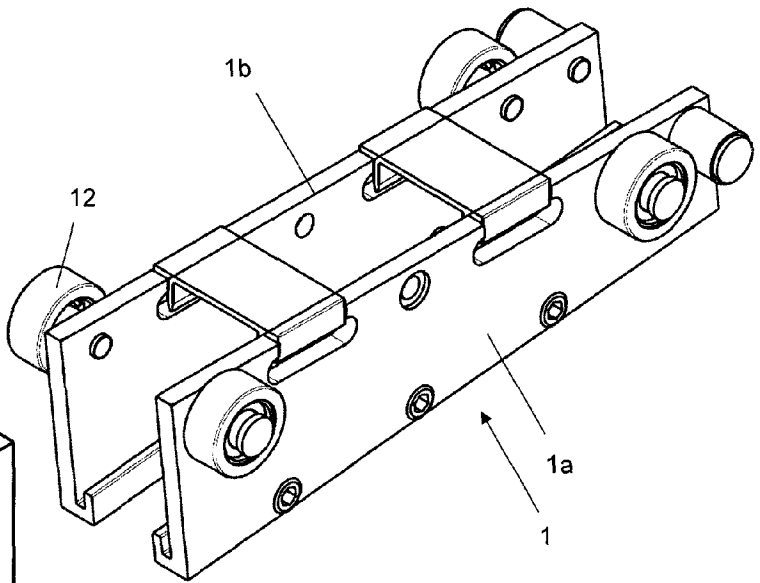
FIGS. 11*a-b* show elements 42*a*, 42*b* of the mounting device 42 incorporated on the upper end of the panel 4.
Figure 11B:
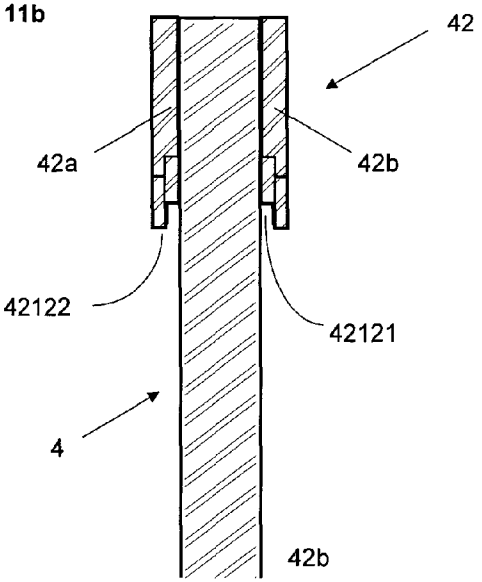
Figure 11A:
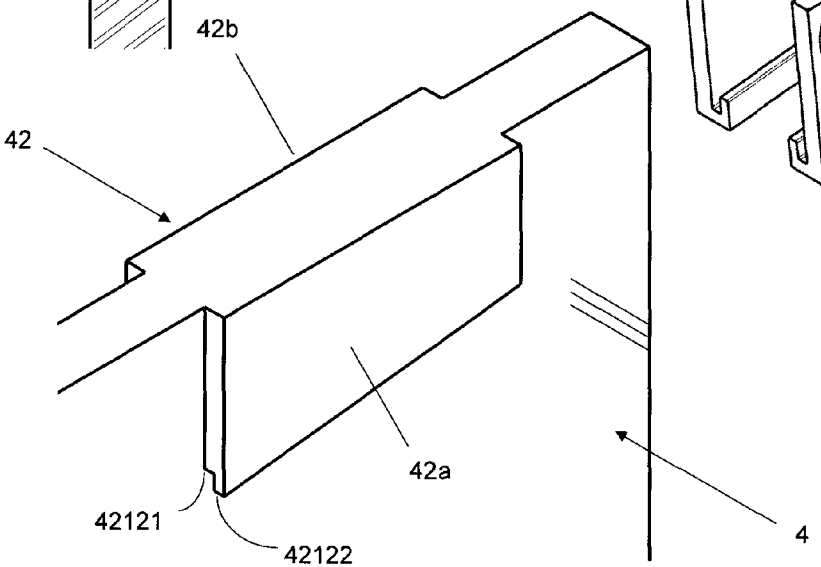

FIG. 11*a* and FIG. 11*b* show elements 42*a*, 42*b* of the mounting device 42 incorporated on the upper end of the panel 4. Hence, the elements 42*a*, 42*b* are formed when the panel 4 is manufactured. Separate mounting elements 21*a*, 21*b* are therefore not required. In this embodiment the panel 4 with the incorporated elements 42*a*, 42*b* can directly be connected to carriage 1, thus reducing mounting efforts, e.g. allowing rapid changes of panels when desired.

FIG. 12 shows a panel 4 with an upper part 43 which is preferably tapered or narrowed in such a way that the assembly parts 21*a*, 21*b* of the mounting device 2 according to FIG. 1 and the carriage parts 1*a*, 1*b* connected thereto do not project over the planes defined by the outer sides 4*a*, 4*b* of the panel 4. After assembly of the carriage 1, the tapered upper part 43 of the panel 4 can thus be covered flush, with a covering element 45 which then forms a planar surface with the panel 4.

FIG. 13 shows a carriage 1 which, like the previously shown carriage 1, can be connected to a mounting device 2. However in this embodiment the running elements are sliding elements 120 and magnetic bearings which are formed by magnets 1200 in the carriage part body 1*a*, 1*b* and magnetic elements 1201 corresponding thereto in the rail 3. Corresponding magnetic bearing devices and also sliding devices are described in [3], WO 2006/032157 A1, which is incorporated herein by reference in its entirety.

Figures 14A, 14B, 14C:
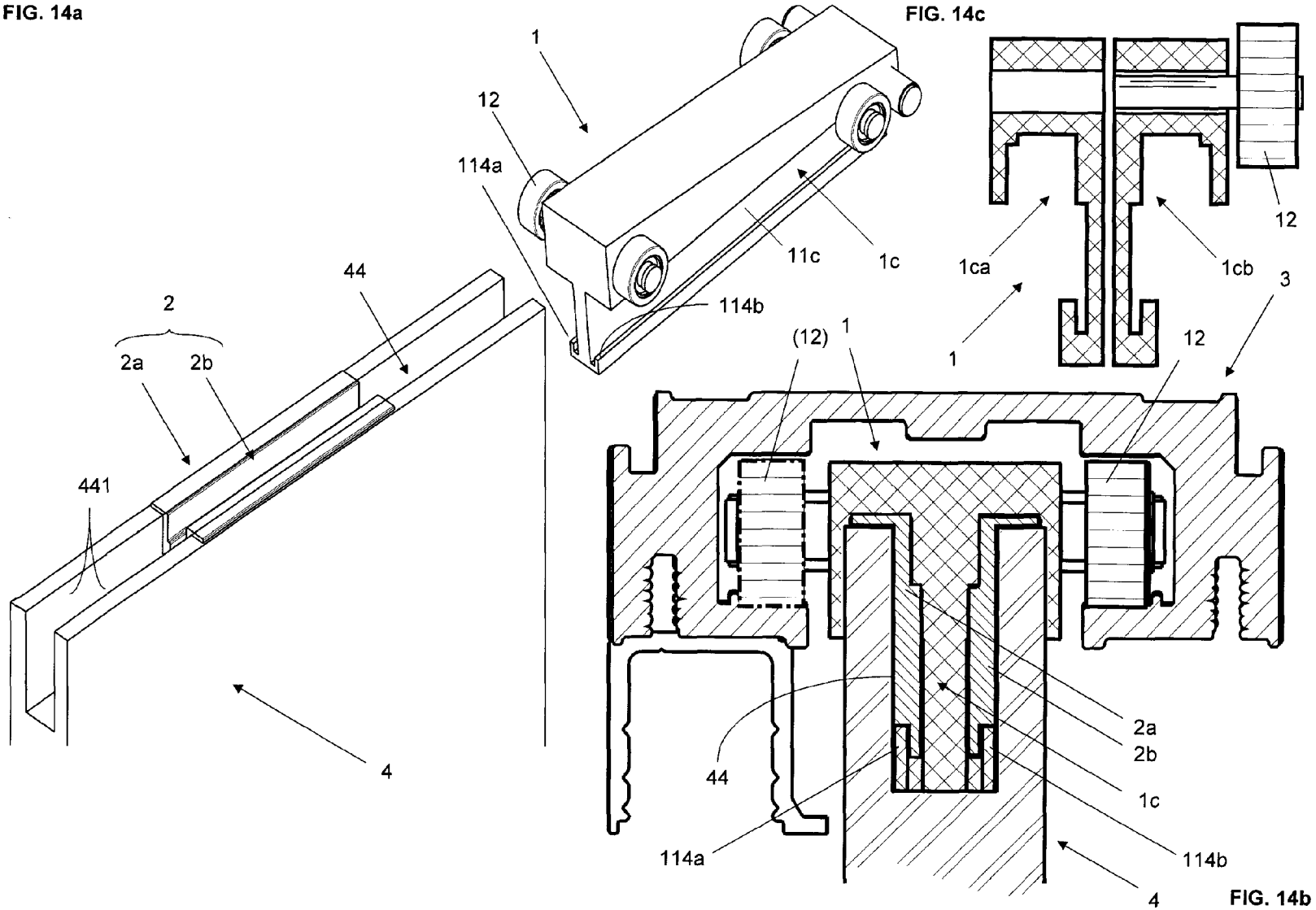
FIGS. 14 *a-c* show a one-part or two-part mounting device 2 which is mounted in a groove provided on the upper side of the panel 4, and a one-part or two-part carriage 1. A single carriage part 1 which can be lowered into the groove 44 is provided on its lower side with anchoring elements 114*a*, 114*b* is shown.

FIGS. 14*a*, 14*b* and 14*c* show a particularly advantageous embodiment of the invention, wherein the mounting device 2 is mounted in a groove 44 provided on the upper side of the panel 4. The carriage 1 according to the invention provided with bearing elements 12 comprises, in the embodiments of FIG. 14*a* and FIG. 14*b*, a single carriage part 1*c* which can be lowered into the groove 44. Carriage part 1*c* is provided on both sides, on its lower side, with anchoring elements 114*a*, 114*b*, each facing a wall 441 of the groove 44. Anchoring elements 114*a* and 114*b* can cooperate with the assembly parts 2*a*, 2*b*; 42*a*, 42*b* (see FIG. 11) of the mounting device 2, 42 provided in groove 44, as has already been explained in relation to FIGS. 10 and 11. The two assembly parts 2*a*, 2*b* can thereby be formed as one part or two parts. In the embodiment shown in FIG. 14*c*, the carriage 1 can also consist of two parts 1*ca*, 1*cb*, preferably complementary and/or symmetrical to each other, of which at least one is provided with a running element 12, for example a wheel mounted by a shaft. For this two-part carriage 1, the same advantages result as for the two-part carriage 1 shown in FIG. 2. Higher manufacturing tolerances are in particular also allowed with this embodiment.

FIG. 15 shows the device of FIG. 1 with a rail 3 which is held in an assembly profile 300 sunk into the ceiling 8. The rail 3, the carriage 1 and the upper side of the panel 4 are thus held and protected within the ceiling 8 and can be completely covered with simple measures, so that, if at all, only a narrow slot, which is scarcely visible, remains between the panel 4 and the ceiling 8.

Figure 16:
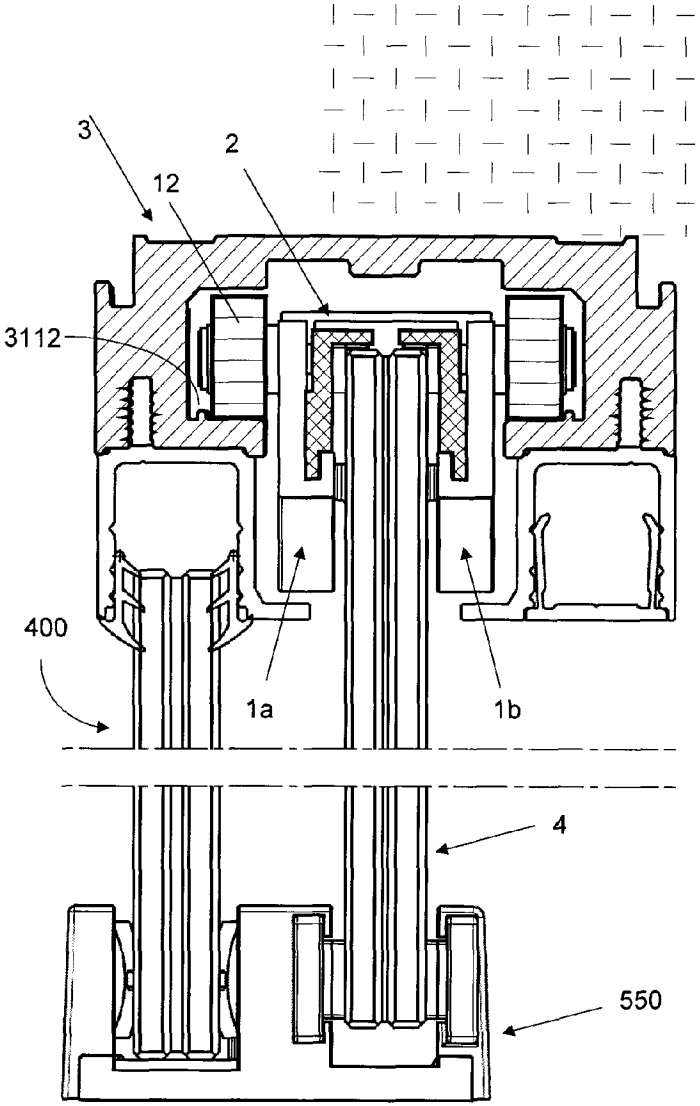
FIG. 16 shows the device of FIG. 1 with a combined bottom guide 550.

FIG. 16 shows the device of Fig. with a combined bottom guide for the glass panels 4 or 400 mounted so that panel 4 is displaceable while panel 400 is held stationary.

FIGS. 17*a* and 17*b* show a single U-profile-shaped bottom guide 5 with a base plate 51, on which a non-releasable and a releasable lateral element 52 or 53 are provided. An elastic element 58, for example a spring held in a frame, can be inserted into each of the lateral elements. The base plate 51 comprises bores 511 for assembly screws and on one side recesses 512 for coupling elements 533 (see FIG. 18*a*) which are provided on the lower side of the releasable lateral element 53. The coupling elements 533 of lateral element 53 can thus be inserted into the recesses 512 and lateral element 53 may be fixed by an assembly screw 96 which can be guided through an opening 531 in the releasable lateral element 53 or on an end flange 532 provided on its lower side.

FIGS. 18*a*, 18*b* and 18*c* show a combined bottom guide 550 with a base plate 510 which comprises in the middle a preferably non-releasable central element 520 and can be equipped on the sides with releasable lateral elements 53, 530 which can be fixed for operation. Lateral elements 53, 530 each comprise an elastic element 58 or 580 respectively. The two releasable lateral elements 53, 530 form, with the base plate 510 and the central element 520, two U-shaped profiles, of which the first serves to guide the displaceable panel 4 and the second to hold the stationary panel 400, as shown in FIG. 15. The central element 520 and the associated releasable lateral element 530 comprise openings 521, in which correspondingly formed elastic elements 580 can be inserted.

The bottom guides 5, 500 allow, after the removal of the two releasable lateral elements 53, 530, the simple installation and de-installation of the displaceable or stationary panel 4, 400 by moving the corresponding panel 4, 400 perpendicularly to the running direction of panel 4. The bottom guide 5, 550 can thus be pre-installed and no longer needs to be dismantled for the installation and de-installation of the panel 4, 400.

Figure 19A:
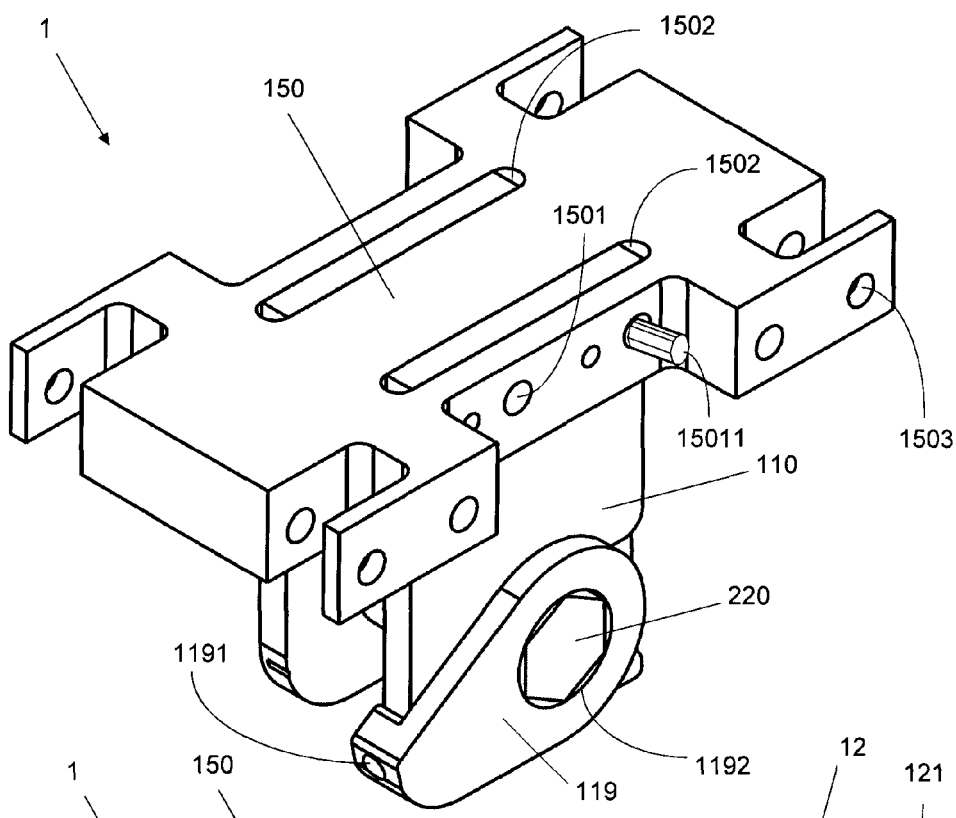
FIG. 19 *a-c* show a carriage 1 with two carriage part bodies 110 which are connected to each other on the one side by a coupling plate provided with running elements 12 and on the other side by an adjustable and fixable bolt 220 which comprises an eccentric part 2203 supported within the opening 31 of the panel 4.
Figure 19B:
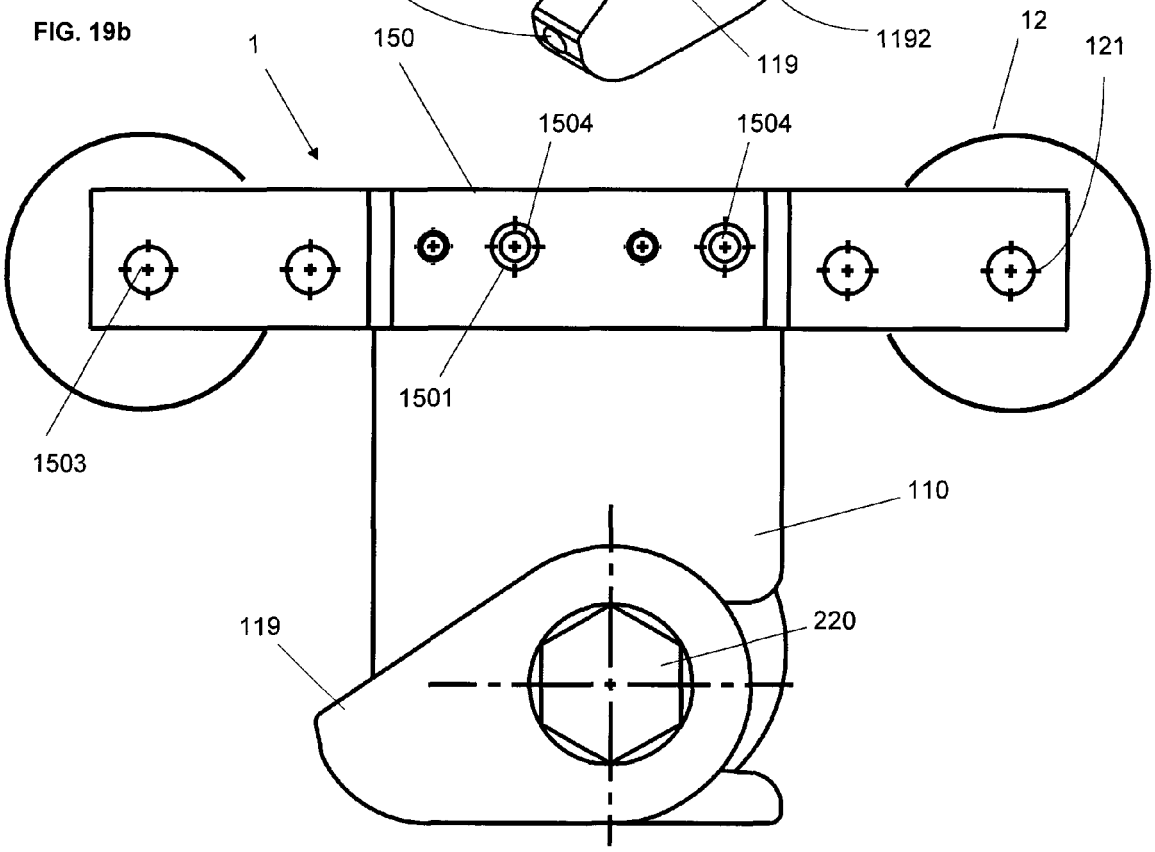
Figure 19C:
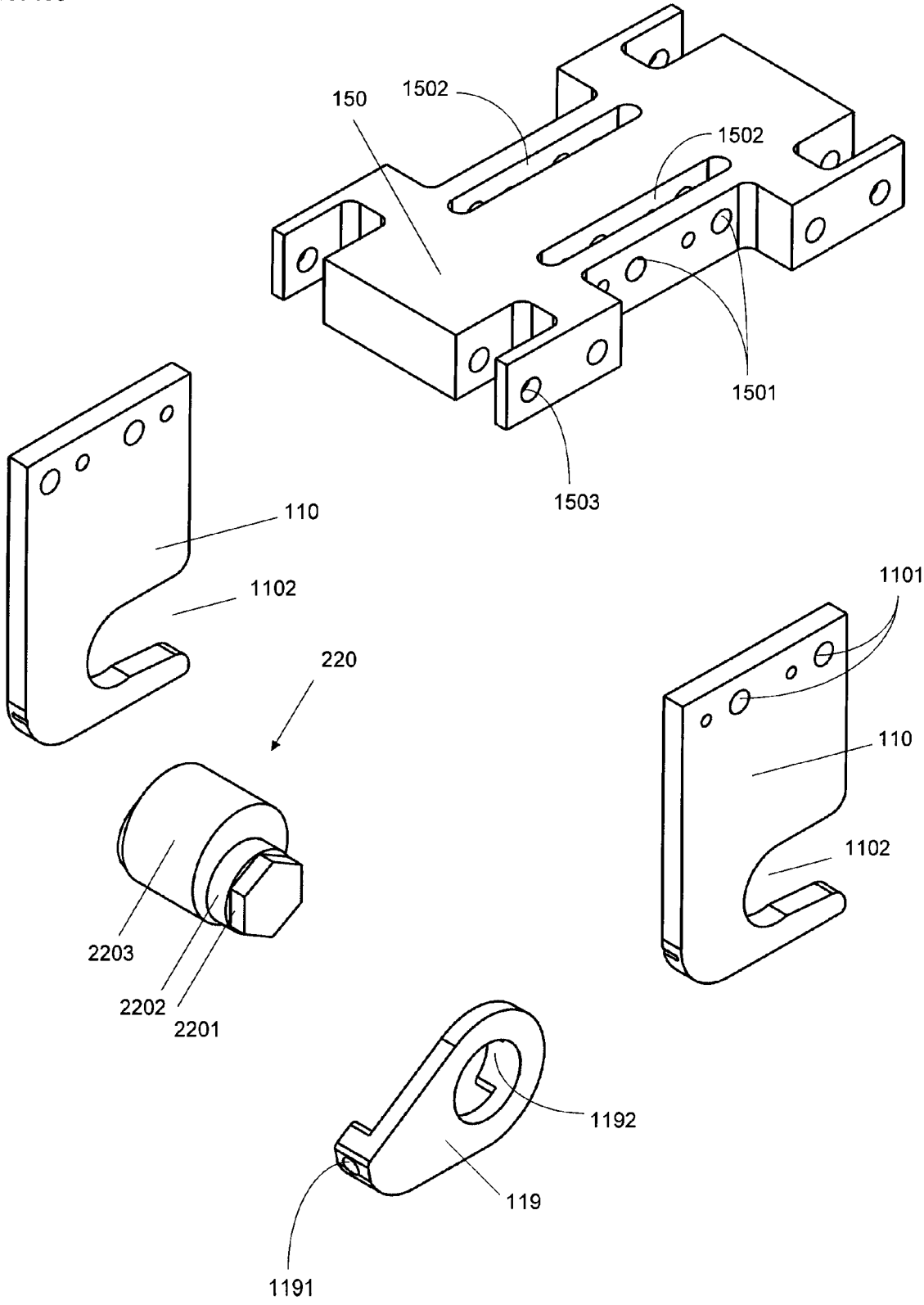

FIGS. 19*a*, 19*b* and 19*c* show a further advantageously formed carriage 1 with two carriage part bodies 110 which are connected or can be connected to each other on the upper side by a coupling plate 150 provided with running elements 12 and on the lower side by an adjustable and fixable bolt 220 which can be guided through an opening 41; 41, 410 in a panel 4.

The carriage part bodies 110 are held above in openings 1502 of the coupling panel 150 by means of retaining bolts 15011 which are introduced into bores 1501 in the coupling plate 150 and guided through bores 1101 in the carriage part body 110. The coupling plate 150 further comprises bores 1503 which each serve to receive the shaft 121 of a wheel 12.

The bolt 220 comprises an eccentric part 2203 held within the opening 41 of the panel 4 (for example according to FIG. 4 or FIG. 6) and bearing elements 2202 connecting thereto on both sides which are held so as to be rotatable within recesses 1102 in the carriage part bodies 110. On one side the bolt 220 comprises a coupling drum 2201 which is held securely in a recess 1192 of an adjusting lever 119. Adjusting lever 119 can be rotated about the axis of the bolt 220 and can be fixed by a screw 98 which can be turned through a threaded bore 1191 in the adjusting lever 119 towards the associated carriage part body 110.

Figure 20A:
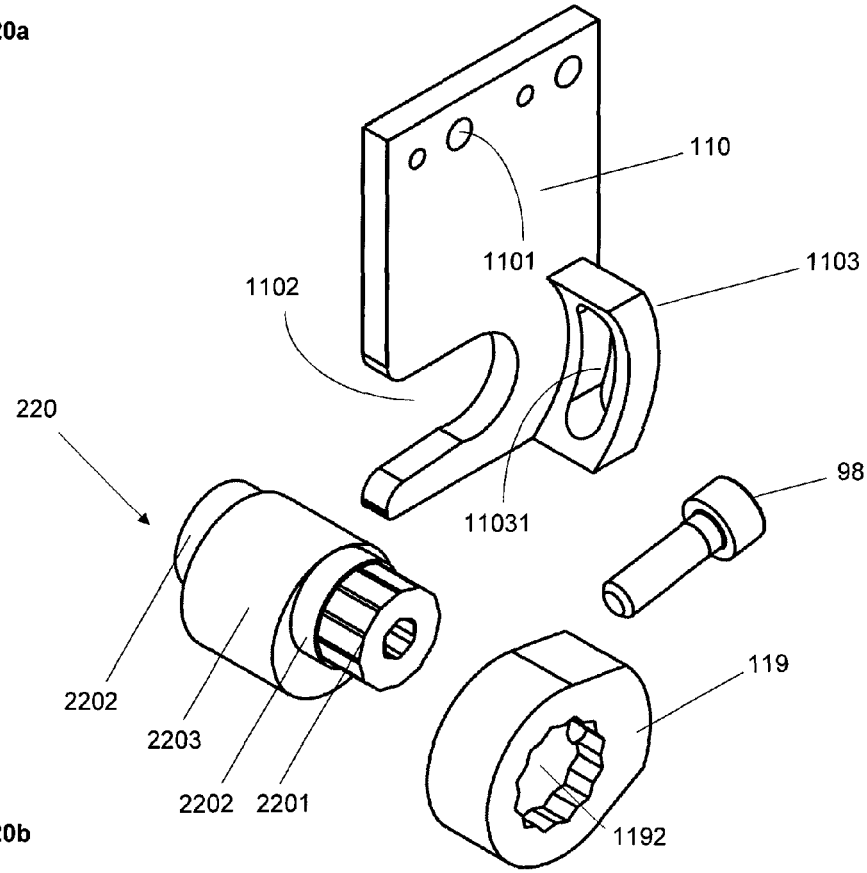
FIG. 20 *a-c* show parts of the carriage 1 of FIG. 19 with preferably formed adjustor and fixer for the bolt 220.
Figure 20B:
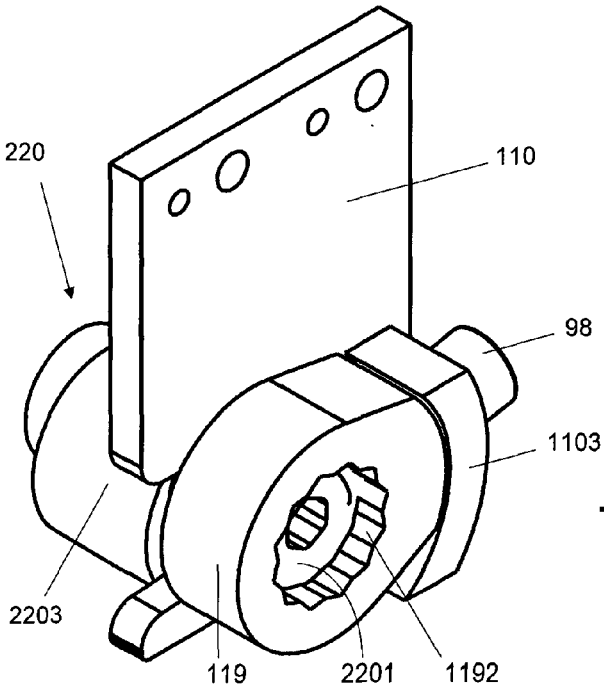
Figure 20C:
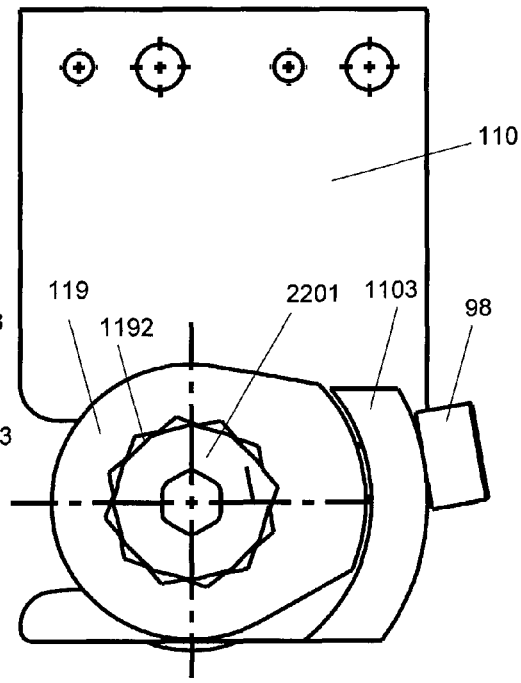

FIGS. 20*a*, 20*b* and 20*c* show the bolt 220 of FIG. 19 and also a preferably formed carriage part body 110 which comprises a fixing flange 1102 with a longitudinal opening provided therein, through which the fixing screw 98 can be connected to a somewhat more simply formed adjusting lever 119. For height adjustment of the panel 4, the adjusting lever 119 can be rotated with the bolt 220 into a suitable position and then fixed by tightening the screw 98.

The carriage 1 shown in FIGS. 19 and 20 which can be simply constructed and cost-effectively produced also allows the panel 4 to be held without essentially covering it.

The device, the carriage and the separation element have been described and shown in preferred embodiments of the invention. By reference to the teaching of the invention, however, numerous further specialist embodiments of the described mounting device can be realised. In particular, further different specialist embodiments of the carriage body can be realised which can be formed in preferred embodiments in one or two parts. The embodiment of the carriage is thereby preferably selected taking into consideration the composition of the panel and the uniformity of the dimensions thereof and also taking into consideration the present production tools and the costs thereof, possibly also taking into consideration the resulting and necessary running properties of the carriage in each case. The materials and substances for the carriage and the mounting device, such as metals and plastics, are preferably selected taking into consideration the same viewpoints. The type, arrangement and number of the at least one running element can likewise be selected to correspond to the requirements in each case.

LITERATURE

[1] WO 98/59140 A1

[2] EP 0 586 840 A1

[3] WO 2006/032157 A1

LIST OF REFERENCE NUMERALS

1 Carriage
1*a*, 1*b* Parts of the carriage 1, complementary to each other
1*c* Single carriage part, with anchoring elements 114*a, b*, provided for engagement in the groove 44,
1*ca*, 1*cb* Parts of the carriage 1, complementary to each other, provided for engagement in the groove 44
11 Carriage part body
11*c* Carriage part body
110 Carriage part body for stable coupling plate
1101 Bore for receiving the retaining bolt 15011
1102 Recess for holding the bolt 220
1103 Fixing flange
11031 Longitudinal opening for the fixing screw 98
111 Bore for receiving a threaded bolt 93
112 Bore for receiving the shaft 121 of a wheel
113 Bore for receiving the assembly shaft 131
114 *a, b* Anchoring element
1140 Receiving groove
115 Recess for receiving the preferably elastic coupling element 15
116 Upper side of the carriage part body 111
117 Lower side of the carriage part body 111
119 Adjusting lever
1191 Threaded bore for receiving the screw 98
1192 Recess in the adjusting lever 119
12 Running elements such as wheels, sliding elements, magnetic bearings
120 Sliding element with magnets 1200
1200 Magnets in pill form
1201 Magnetic rail element
21 Shaft of the wheel 12
122 Roller of the wheel 12
13 Locking element
131 Assembly shaft
132 Locking cylinder
15 Preferably elastic coupling element 15
150 Coupling plate with wheels 12
151 Bracket elements
152 Connecting element, possibly foldable
1501 Bore for receiving the coupling shaft 1503
15011 Retaining bolt
1502 Recess for receiving the carriage part body
1503 Bore for receiving the shaft 121 of the wheel
2 Mounting device
21*a*, 21*b* Assembly parts of the mounting device 2
211 Head part of the assembly part 21*a* or 21*b*
212 Lateral part of the assembly part 21*a* or 21*b*
2121 Preferably convex shoulder
2122 Preferably convex flange
2123 Upper side of the assembly part 21*a* or 21*b*
2124 Lower side of the assembly part 21*a* or 21*b*
213 Opening for receiving the assembly screw 92
22 Bolt with threaded bore 221
220 Bolt with bearing elements 2202
2201 Coupling drum
2202 Bearing elements
2203 Eccentric element
221 Threaded bore
24 Protective elastic element
25 Bearing element with a passage opening 251
251 Round or slot-like passage opening for the bolt 22
26 Damping elements for the slot-like passage opening 251
3 Rail
300 Assembly profile
31*a*, 31*b* Lateral parts of the rail 3

311 Foot element of the lateral part 31*a* or 31*b*
3111 Running surface
3112 Resilient strip
312 Screw channel for the assembly of the auxiliary profile 35
32 Central part of the rail 3
321 Bore for guiding through the assembly screws 91
35 Auxiliary profile
3501 Seal
3502 Covering element
351 Channel for receiving the stationary panel 4
352 Covering wing
4 Panel, particularly glass panel, held by means of at least one carriage 1
400 Stationary panel, particularly glass panel
4*a*, 4*b* Left and right front side of the glass panel 4
41 Recess for receiving the bolt 22 or the bearing element 25 provided with the bolt 22
410 V-shaped cutout partially overlapping the opening 41
42 Mounting device integrally on the panel
42121 Preferably convex shoulder
42122 Preferably convex flange
43 Narrower upper part
44 Groove in the upper side of the panel 4
441 Sides of the groove 44, lying opposite each other
45 Covering element
5 Bottom guide for the glass panel 4
500 Bottom guide for the stationary glass panel 400
51 Base plate of the single bottom guide 5
510 Base plate of the combined bottom guide 550
511 Bores in the base plate 51
512 Receiving openings in the base plate 51
52 Non-releasable lateral element
520 Non-releasable central element
521 Receiving opening for the elastic element 580
53, 530 Releasable lateral elements
531 Opening for receiving the assembly screw 96
532 Closure flange
533 Coupling element corresponding to the receiving opening 512
550 Combined bottom guide for the glass panels 4, 400
58 Elastic element for the displaceable panel 4
580 Elastic element for the stationary panel 400
6*a*, 6*b* Buffer devices symmetrical to each other
61 Buffer body
611 Groove in the buffer body for receiving the resilient strip
612 Bore in the buffer body 61 for a screw 95
613 Assembly groove
62 Buffer spring
63 Elastic buffer element
8 Ceiling
91 Assembly screws for the rail 3
92 Assembly screws for the assembly parts 21*a*, 21*b*
93 Threaded bolt possibly with cup point
94 Screw for assembly of the buffer spring
95 Threaded bolt possibly with cup point
96 Assembly screw for the bottom guide 5, 550
97 Screws for assembly of the auxiliary profile 35
98 Screw for fixing the adjusting lever 1109

The invention claimed is:

1. A panel holding carriage for supporting said panel on a rail slidingly along a moving axis, the carriage comprising:

two mounting elements, for mounting on opposite sides of said panel, each mounting element having a flange element;

two carriage body parts, each comprising:

a plate having an upper side a first side facing said mounting elements, and a second side opposite thereto;

at least one running element coupled to said second side of said plate;

and at least one anchor coupled to said first side of said plate;

wherein said anchor comprising an upwardly open receiving anchor groove being inclined relative to said upper side of said plate, and dimensioned to respectively receive said flange element.

2. A panel holding carriage according to claim 1, further comprising a) a threaded pin, wherein each carriage body part comprises at least one threaded hole for receiving said threaded pin which can be threadably advanced towards the panel; and b) a bearing shaft holding a wheel, wherein each carriage body part comprises at least one hole for receiving said bearing shaft, the wheel serving as said running element and adapted to be supported by a running surface provided on a foot element of said rail.

3. A panel holding carriage according to claim 2, further comprising:

a) an assembly shaft with a locking element, wherein each carriage body part comprises at least one hole dimensioned for receiving said assembly shaft, or b) a coupling element, wherein each carriage body part comprises at least one recess for engaging said coupling element, to rigidly connect the two carriage body parts.

4. A panel holding carriage according to claim 1, wherein the carriage body parts are spaced apart and symmetrically formed.

5. A panel holding carriage according to claim 1, wherein the carriage body parts are firmly connected to one another and symmetrically formed.

6. A panel holding carriage for supporting said panel on a rail slidingly along a moving axis, the carriage comprising:

two mounting elements, for mounting on opposite sides of said panel, each mounting element having a flange element;

two carriage body parts, each comprising:

a plate having and upper side a first side facing said mounting elements, and a second side opposite thereto;

at least one running element coupled to said second side of said plate;

at least one anchor coupled to said first side of said plate;

said anchor comprising an upwardly open receiving anchor groove being inclined relative to said upper side of said plate, and dimensioned to respectively receive said flange element;

an assembly shaft with a locking element, wherein each carriage body part comprises at least one hole dimensioned for receiving said assembly shaft with a locking element.

* * * * *